US007905121B2

(12) United States Patent
Ikemizu et al.

(10) Patent No.: US 7,905,121 B2
(45) **Date of Patent: *Mar. 15, 2011**

(54) WASHING MACHINE WITH ION ELUTING AND IMBALANCE CORRECTING UNITS

(75) Inventors: Mugihei Ikemizu, Osaka (JP); Hirofumi Yoshikawa, Osaka (JP); Masahiro Nishio, Kitakatsuragi-Gun (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 885 days.

This patent is subject to a terminal disclaimer.

(21) Appl. No.: 10/550,002

(22) PCT Filed: Apr. 9, 2004

(86) PCT No.: PCT/JP2004/005181

§ 371 (c)(1),
(2), (4) Date: Sep. 23, 2005

(87) PCT Pub. No.: WO2004/094716

PCT Pub. Date: Nov. 4, 2004

(65) Prior Publication Data

US 2006/0185403 A1 Aug. 24, 2006

(30) Foreign Application Priority Data

Apr. 22, 2003 (JP) ..... 2003-117447

(51) Int. Cl.
*D06F 33/00* (2006.01)

(52) U.S. Cl. ..... 68/12.06; 68/12.18; 68/12.19

(58) Field of Classification Search ..... 68/12.06, 68/13 A

See application file for complete search history.

(56) References Cited

U.S. PATENT DOCUMENTS 6,023,854 A 2/2000 Tsunomoto et al.
6,032,494 A 3/2000 Tanigawa et al.
6,286,344 B1 * 9/2001 Jeon et al. ..... 68/23.1

FOREIGN PATENT DOCUMENTS

CH 662 804 A5 10/1987

(Continued)

OTHER PUBLICATIONS

Machine Translation of Ando et al. JP 2001-276484, Oct. 2001.*

*Primary Examiner* — Micheal Barr
*Assistant Examiner* — David Cormier
(74) *Attorney, Agent, or Firm* — Birch, Stewart, Kolasch & Birch, LLP

(57) ABSTRACT

A washing machine includes: a drum (630) in which laundry is put; an ion elution unit that elutes metal ions and adds them to water; a sensing unit (701) for sensing imbalance at the time of rotation of the laundry tub; and an imbalance correcting unit (702). When the sensing unit senses imbalance in the drum at the time of spin-drying rotation of the drum performed after metal ion added water supplied from the ion elution unit to the drum is supplied, the imbalance correcting unit corrects the imbalance by performing a processing different from a processing performed when imbalance is sensed in a case where the metal ion added water is not supplied. The different processing is not supply of tap water but balance correction rinsing in which the metal ion added water is supplied to the drum and agitation is performed.

8 Claims, 13 Drawing Sheets

FOREIGN PATENT DOCUMENTS

| | | | | |
|---|---|---|---|---|
| EP | 0 668 388 | A1 | | 8/1995 |
| EP | 0 781 881 | A1 | | 7/1997 |
| EP | 1 445 367 | A1 | | 8/2004 |
| EP | 1 580 313 | A1 | | 9/2005 |
| GB | 2 260 547 | A | | 4/1993 |
| JP | 56-69372 | A | | 10/1954 |
| JP | 56-69372 | | * | 6/1981 |
| JP | 57-96686 | A | | 6/1982 |
| JP | 3-97497 | A | | 4/1991 |
| JP | 5-74487 | A | | 10/1993 |
| JP | 6-269592 | A | | 9/1994 |
| JP | 2001-9188 | A | | 1/2001 |
| JP | 2001-046790 | A | | 2/2001 |
| JP | 2001-276469 | | | 10/2001 |
| JP | 2001-276484 | A | | 10/2001 |
| JP | 2001276484 | A | * | 10/2001 |
| JP | 2002-113288 | A | | 4/2002 |
| JP | 2002-263397 | A | | 9/2002 |
| JP | 2004-166938 | A | | 6/2004 |
| WO | WO 0171084 | A2 | * | 9/2001 |
| WO | WO-2004/003280 | A1 | | 1/2004 |
| WO | WO-2004/011710 | A1 | | 2/2004 |

* cited by examiner

WASHING MACHINE WITH ION ELUTING AND IMBALANCE CORRECTING UNITS

BACKGROUND OF THE INVENTION

1. Field of the Invention

The present invention relates to a washing machine that supplies metal ion added water from ion eluting means to a laundry tub (a drum or a washing tub) and performs an antibacterial treatment on the laundry being put in the laundry tub, and more particularly, to a washing machine that corrects imbalance in the laundry tub at the time of rotation for spin-drying.

2. Description of the Related Art

When laundry is washed in a washing machine, a treatment substance is frequently added to water (in particular, rinsing water). Typical examples of such a treatment substance are a fabric softener and starch. In addition to these, the demand for a finishing treatment to render laundry antibacterial has been increasing in recent years.

From the hygienic point of view, it is desirable that laundry be dried in the sun. However, in recent years, with the increase in the number of working women and with the increase in the number of nuclear families, there have been an increasing number of households where no one is at home during the daytime. In these households, there is no choice but to dry laundry indoors. Even in households where someone is at home during the daytime, laundry is dried indoors when it is raining.

When laundry is dried indoors, compared to when laundry is dried in the sun, bacteria and mold readily propagate in the laundry. This tendency is marked when laundry drying takes time such as when humidity is high like in a rainy season or when temperature is low. Depending on the propagation condition, there are cases where laundry becomes smelly.

Moreover, recently, with growing awareness of thriftiness, more and more households reuse water that is left in the bath tub after bathing, for laundry washing. However, bacteria have increased in water left in the bath tub overnight, and the bacteria adhere to laundry and further propagates to make the laundry smelly.

For this reason, there is a strong demand that an antibacterial treatment be performed on clothes to suppress the propagation of bacteria and mold, from households having no other choice but to dry laundry indoors every day and households reusing water left in the bath tub for laundry washing.

On the other hand, many clothes having undergone an antibacterial and deodorizing treatment or a microbial control treatment have recently been available. However, it is difficult that the textile goods in a household are all ones having undergone an antibacterial and deodorizing treatment. Moreover, the efficacy of the antibacterial and deodorizing treatment decreases as textile goods are washed repeatedly.

Under these circumstances, an idea was conceived of performing an antibacterial treatment on laundry every time it is washed. For example, Patent Document 1 discloses an electric washing machine provided with an ion generator that generates metal ions having sterilizing power such as silver ions or copper ions. Patent Document 2 discloses a washing machine provided with a silver ion adding unit that adds silver ions to cleaning water. In particular, in the washing machine of Patent Document 2, silver ions are added to water in a concentration of 3 to 50 ppb (part per billion) to render the laundry antibacterial.

Patent Document 1 is Japanese Unexamined Utility Model Application Publication "Utility Model Laid-Open No. H5-74487 (laid-open on Oct. 12, 1993)." Moreover, Patent Document 2 is Japanese Unexamined Patent Application Publication "Patent Application Laid-Open No. 2001-276484 (laid-open on Oct. 9, 2001)."

The washing machines of Patent Documents 1 and 2 are both so-called vertical washing machines (vertical washing) where the washing tub is disposed so that the rotation axis thereof is in the vertical direction. However, in recent years, so-called slanted washing machines (drum washing) where the drum is disposed so that the rotation axis thereof is at an angle with respect to the vertical direction have also been developed.

In vertical washing machines, since the rotation axis of the washing tub is in the vertical direction, the gravity acting on the laundry is in a direction parallel to the rotation axis. In this case, leaning does not readily occur in the washing tub, and the center of gravity of the laundry is apt to be on the rotation axis. Consequently, imbalance does not readily occur, either. Here, imbalance refers to a phenomenon in which when the laundry being put in the washing tub is not evenly spread in the washing tub, the washing tub cannot keep its balance at the time of start of rotation for spin-drying and the washing tub and the washing machine body largely shake in the subsequent spin-drying operation. Moreover, in vertical washing machines, the center of gravity of the washing tub is on the rotation axis that is in the vertical direction, and the rotation axis is situated immediately above the motor. For this reason, the load of the washing tub can be sustained by the motor portion.

On the other hand, in slanted washing machines, since the rotation axis is not in the vertical direction, the gravity acting on the laundry is not in the direction of the rotation axis. That is, when the drum is stopped, the laundry gathers in a lower part of the drum, and under that condition, the center of gravity of the laundry is not on the rotation axis. When the drum is rotated and the centrifugal force acts on the laundry, the laundry is pressed in the circumferential direction of the drum, and when the laundry is not uniformly pressed, imbalance occurs. Consequently, in slanted washing machines where the rotation axis is not in the vertical direction, the frequency of occurrence of imbalance is extremely high because of its structure.

Therefore, it is necessary to correct such imbalance, and a common method of correcting this is to pour water into the drum and agitate it to thereby slightly change the disposition of the laundry. However, only pouring water into the drum cannot make it possible to maintain the efficacy of the antibacterial treatment that is performed with time and trouble being taken, because the metal attached to the laundry in the upstream operation of the spin-drying operation is lost. This problem also arises when imbalance occurs in vertical washing machines.

SUMMARY OF INVENTION

The present invention is made to solve the above-mentioned problem, and an object thereof is to provide a washing machine capable of correcting imbalance in the laundry tub at the time of rotation for spin-drying without any loss of the antibacterial effect by the metal ion added to the laundry.

To achieve the above-mentioned object, according to a washing machine of the present invention, when sensing means senses imbalance in the laundry tub at the time of spin-drying rotation of the laundry tub performed after metal ion added water supplied from ion eluting means to the laundry tub is supplied, imbalance correcting means corrects the imbalance by performing a processing different from a processing performed when imbalance is sensed in a case where the metal ion added water is not supplied.

Examples of the imbalance correction in a case where the metal ion added water is not supplied include a processing of supplying water (for example, tap water) to the laundry tub and agitating the laundry. Therefore, as the processing different from this, balance correction rinsing in which the metal ion added water obtained by the ion eluting means is supplied to the laundry tub and agitation is performed can be considered.

As described above, when the sensing means senses imbalance in the laundry tub at the time of spin-drying rotation of the laundry tub performed after the metal ion added water is supplied, by performing the processing different from the processing of supplying normal tap water, that is, the supply of the metal ion added water, even if metal ions added to the laundry in the antibacterial treatment by the supply of the metal ion added water are washed away, the metal ions having been washed away can be surely made up for by the supply of the metal ion added water performed later. Consequently, imbalance correction can be performed without any loss of the antibacterial effect added to the laundry in the preceding antibacterial treatment. That is, imbalance correction can be performed while the efficacy of the antibacterial treatment on the laundry is ensured.

Moreover, the imbalance correcting means may perform control so that the amount of supply of the metal ion added water to the laundry tub in the balance correction rinsing is smaller than the amount of supply of the metal ion added water in a preceding operation. Since metal ions of an amount necessary for delivering the antibacterial effect on the laundry have already been supplied in the preceding metal ion added water supplying operation (for example, the rinsing operation), it is unnecessary to re-supply metal ions of the amount necessary for delivering the antibacterial effect even if the amount washed away in the succeeding balance correction rinsing is considered. With this, it can be prevented that metal ions are washed away without being used for the antibacterial treatment on the laundry in the balance correction rinsing and useless metal ions appear.

Moreover, similar effects as those mentioned above can be obtained when the imbalance correcting means performs control so that the metal ion concentration of the metal ion added water to the laundry tub in the balance correction rinsing is lower than the metal ion concentration of the metal ion added water in a preceding operation.

DETAILED DESCRIPTION OF THE INVENTION

Describing an embodiment of the present invention with reference to FIGS. 1 to 14 is as follows:

(1. Structure of the Washing Machine)

Figure 1:
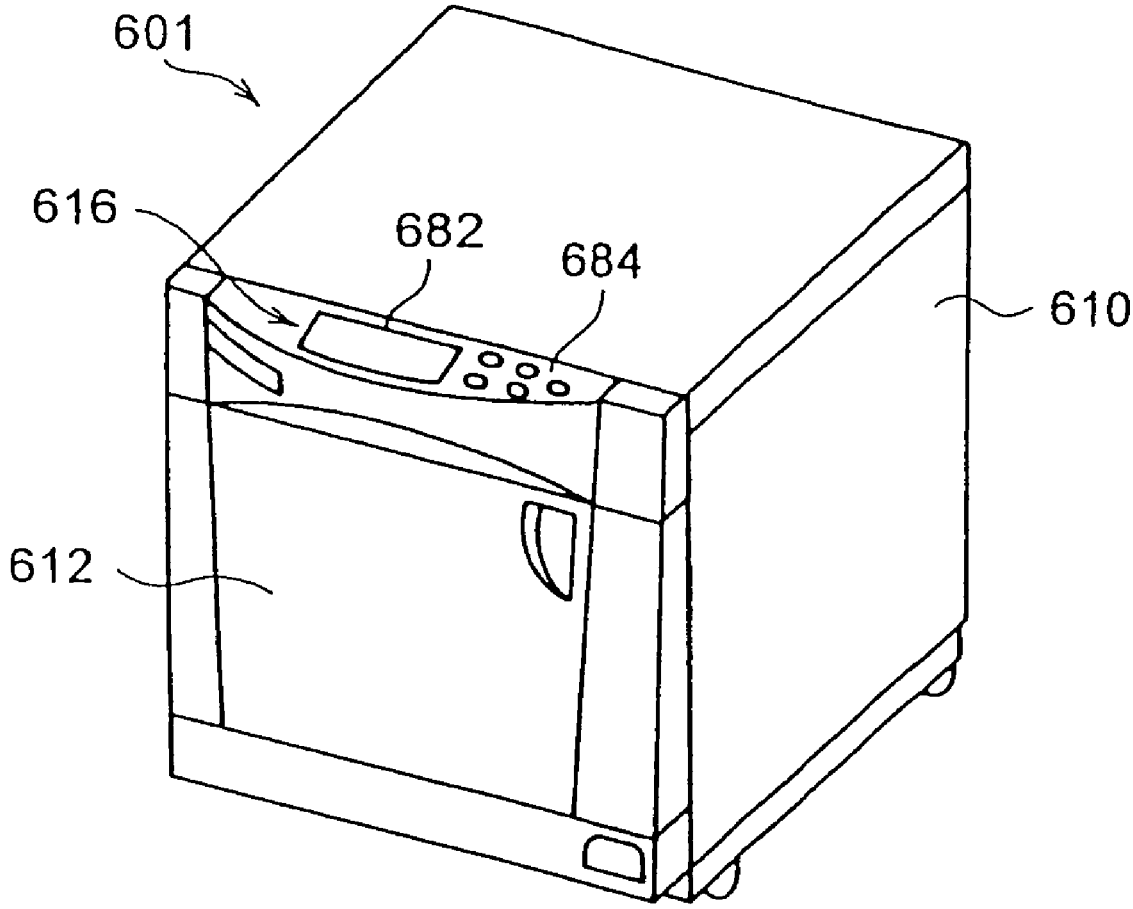
FIG. 1 is a perspective view showing the external structure of a slanted drum washing machine according to an embodiment of the present invention.
Figure 2:
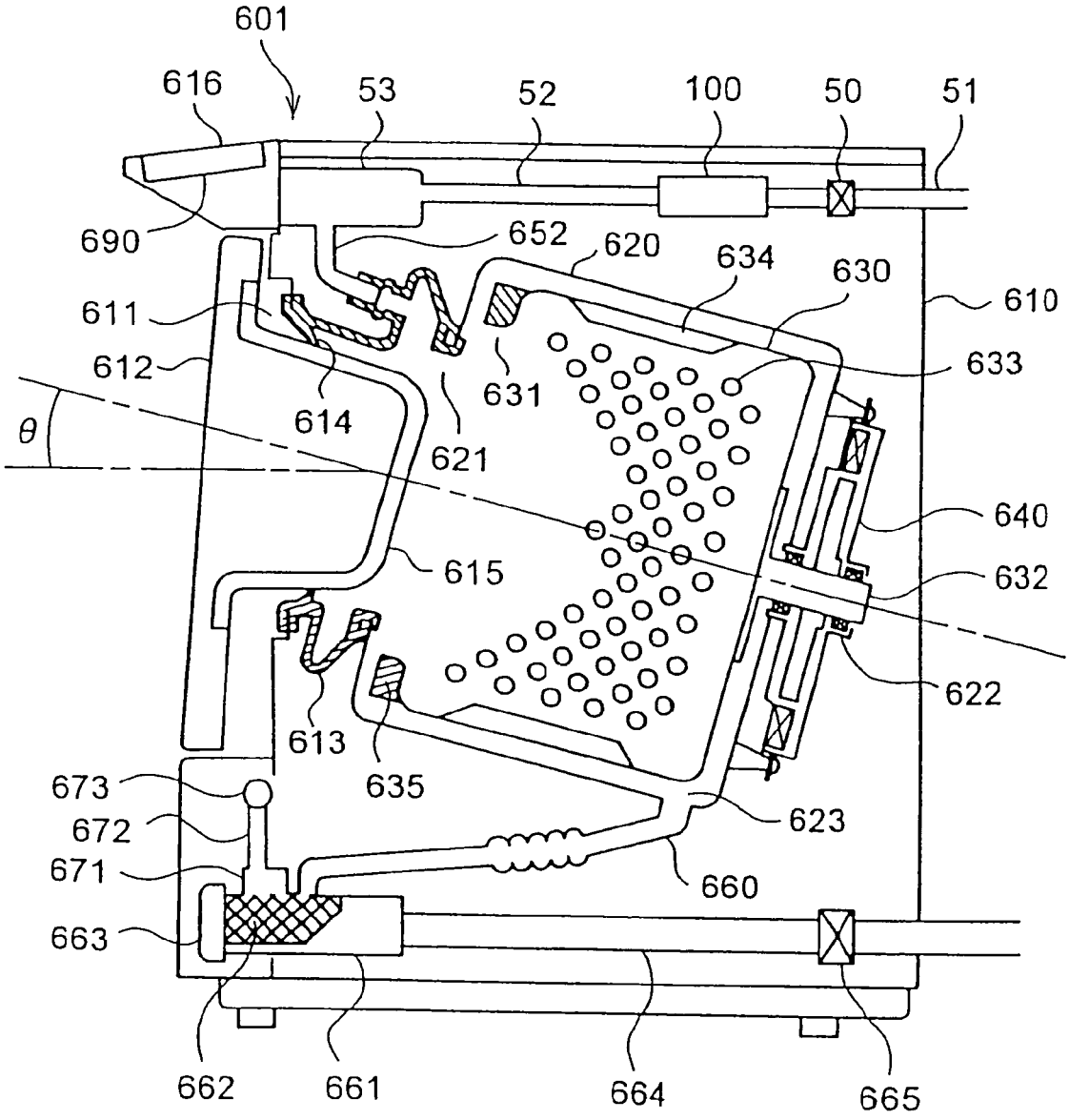
FIG. 2 is a vertical cross-sectional view showing the schematic structure of the washing machine.

FIG. 1 is an external perspective view of a slanted drum washing machine 601 according to the present embodiment. FIG. 2 is a vertical cross-sectional view of the slanted drum (slanted) washing machine 601. The slanted drum washing machine 601 has a box-shaped body 610. Inside the body 601, a water tub 620 and a drum 630 in which laundry is put are disposed. The water tub 620 and the drum 630 are both cylindrical, and have laundry putting-in openings 621 and 631 on one end surfaces, respectively.

A shaft 632 protrudes outward from the center of the bottom of the drum 630. By the shaft 632 being held by a bearing 622 provided in the center of the bottom of the water tub 620, the drum 630 and the water tub 620 are concentrically disposed with the drum 630 inside and the water tub 620 outside.

The water tub 620 and the drum 630 are held inside the body 610 by a non-illustrated suspension mechanism so that the axis thereof is substantially horizontal. In the present embodiment, as shown in FIG. 2, the axis of the water tub 620 and the drum 630 is inclined at an angle θ (for example, 15°) to horizontal, and the side of the laundry putting-in openings 621 and 631 are slightly lifted up. That is, the water tub 620 and the drum 630 are disposed so that the rotation axis is at an angle with respect to the vertical direction. This is done in order to make it easy to see the inside of the drum 630 and make it easy to put in and out laundry.

In the slanted drum washing machine 601, while the inclination angle θ is assumed to be in a range of 0° to 30°, it is not limited to this range as long as the rotation axis is at an angle with respect to the vertical direction.

On the front side external wall of the body 610, an opening 611 is provided so as to be opposed to the laundry putting-in openings 621 and 631, and in front of the opening 611, a horizontally opening door 612 is provided. The opening 611 and the laundry putting-in opening 621 are coupled together by a door packing 613 made of soft synthetic resin or rubber. The door packing 613 is provided for preventing the inside of the body 610 from being wetted by water splashes caused in the drum 630, water drops caused when wet laundry is put in or out, and spilled water from the laundry putting-in opening 621.

A ring-shaped lip 614 is integrally formed on the inner surface of the door packing 613. The lip 614 is in intimate contact with the periphery of a protrusion 615 provided on the inner surface of the door 612 to thereby prevent water from leaking through a gap between the door packing 613 and the door 612. The protrusion 615 plays a role of preventing the laundry in the drum 630 from being forced out of the laundry putting-in opening 621. The protrusion 615 may be made of a transparent material so that the inside of the drum 630 is visible.

A multiplicity of dewatering holes 633 are formed on the circumferential wall of the drum 630, and water moves between the drum 630 and the water tub 620 through the dewatering holes 633. A plurality of baffles 634 are disposed at predetermined intervals on the inner surface of the drum 630. The baffles 634 pick up the laundry and drop it from above as the drum 630 rotates.

A balance weight (balancer) 635 is attached to the external surface of the drum 630 and the laundry putting-in opening 631. FIG. 2 shows only a ring-shaped balance weight 635 attached to the laundry putting-in opening 631 and does not show the balance weight attached to the external surface of the drum 630. The balance weight 635 suppresses shakes caused when the drum 630 rotates at high speed.

A motor 640 is attached to the external surface of the bottom of the water tub 620. The motor 640 is of a direct drive type, and to the rotor thereof, the shaft 632 of the drum 630 is coupled so as to be fixed. The shaft 622 is attached to the housing of the motor 640, and constitutes a part of the motor 640.

An electromagnetically opening and closing water supply valve 50 is disposed in a space above the water tub 620. The water supply valve 50 has a connection pipe 51 protruding rearward through the body 610. To the connection pipe 51, a water supply hose (not shown) supplying clean water such as tap water is connected. A water supply pipe 52 extends from the water supply valve 50. An end of the water supply pipe 52 is connected to a container-shaped water supply mouth 53. The water supply mouth 53 has a structure shown in FIG. 3.

Figure 3:
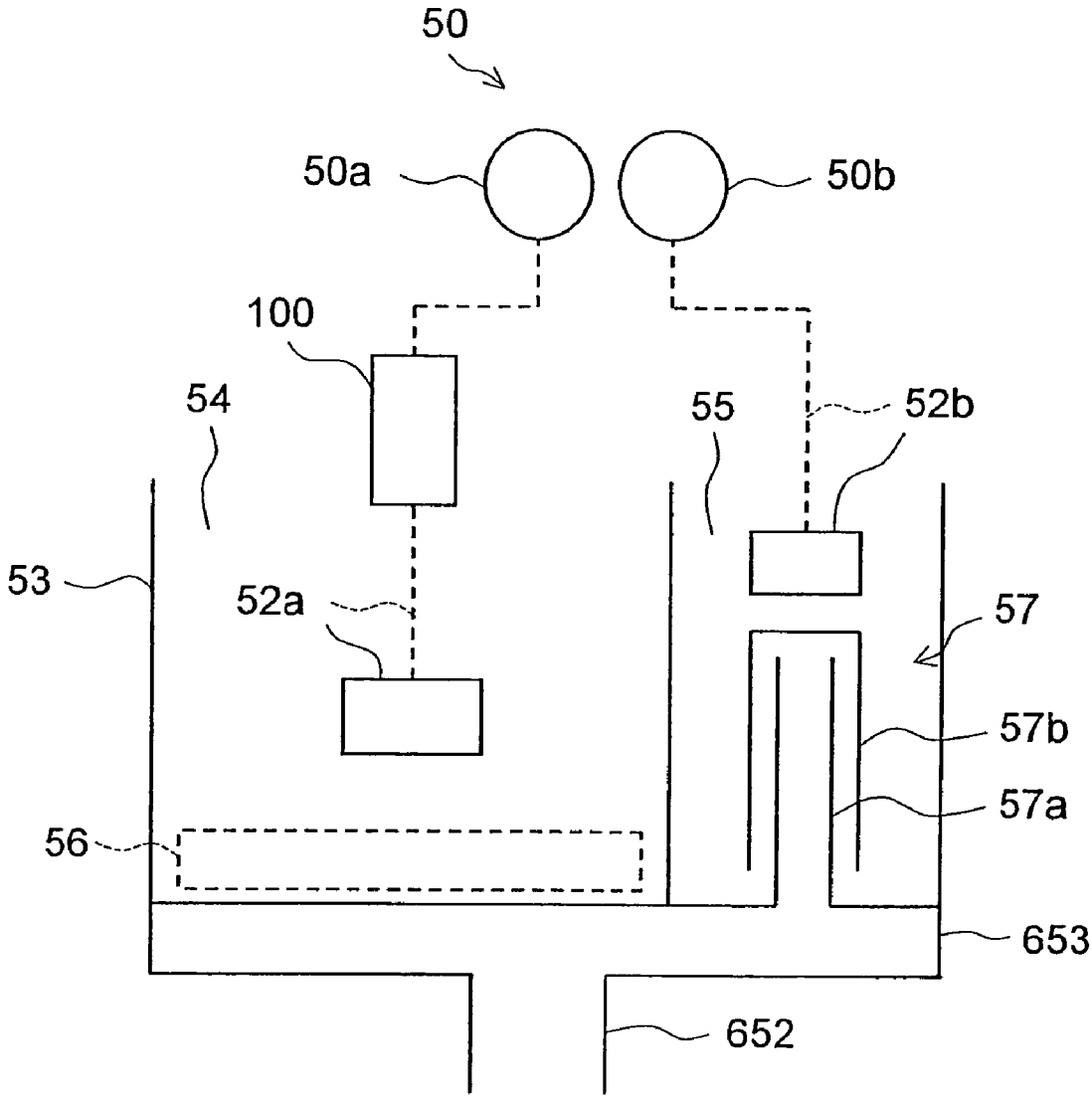
FIG. 3 is an explanatory view schematically showing the structure of a water supply mouth provided in the washing machine.

FIG. 3 is an explanatory view schematically showing the structure of the water supply mouth 53 viewed from the front side. The water supply mouth 53 is open at its top, and the inside thereof is divided into the left and right sections. The left section is a detergent chamber 54 serving as a preparation space for storing a detergent. The right section is a finishing agent chamber 55 serving as a preparation space for storing a finishing agent for laundry washing. A water outlet 56 for pouring water to a catchment measure 653 of a water supply nozzle 652 connected to an upper part of the door packing 613 is provided at the bottom of the detergent chamber 54. A siphon 57 also for pouring water to the catchment measure 653 is provided in the finishing agent chamber 55.

The siphon 57 comprises an inner pipe 57*a* that extends vertically upward from the bottom surface of the finishing agent chamber 55 and a cap-shaped outer pipe 57*b* with which the inner pipe 57*a* is capped. A gap allowing water to pass therethrough is formed between the inner pipe 57*a* and the outer pipe 57*b*. The bottom of the inner pipe 57*a* is open to the inside of the catchment measure 653. A predetermined gap is kept between the bottom end of the outer pipe 57*b* and the bottom surface of the finishing agent chamber 55, and this gap serves as a water inlet. When water is poured into the finishing agent chamber 55 up to a level higher than the top end of the inner pipe 57*a*, siphonage occurs to cause the water to flow through the siphon 57 out of the finishing agent chamber 55 and drop into the catchment measure 653.

The water supply valve 50 comprises a main water supply valve 50*a* and a sub water supply valve 50*b*. The connection pipe 51 is common to the main water supply valve 50*a* and the sub water supply valve 50*b*. The water supply pipe 52 comprises a main water supply pipe 52*a* connected to the main water supply valve 50*a* and a sub water supply pipe 52*b* connected to the sub water supply valve 50*a*.

The main water supply pipe 52*a* is connected to the detergent chamber 54, and the sub water supply pipe 52*b* is connected to the finishing agent chamber 55. That is, a path from the main water supply pipe 52*a* through the detergent chamber 54 into the catchment measure 653 and a path from the sub water supply pipe 52*b* through the finishing agent chamber 55 into the catchment measure 653 are formed, and further, these are different paths.

The top of the detergent chamber 54 and the top of the finishing agent chamber 55 are both open toward the outside of the body 610. For each of these openings, a non-illustrated lid is provided. The user lifts the lid as required, and puts a detergent into the detergent chamber 54, and a finishing agent into the finishing agent chamber 55.

Returning to FIG. 2, description will be continued. A drain outlet 623 is provided in the lowest position of the water tub 620, and an end of a drain pipe 660 is connected thereto. The other end of the drain pipe 660 is connected to a filter casing 661. A lint filter 662 is inserted in the filter casing 661. The lint filter 662, which is made of a net of synthetic resin or cloth, collects lint in the washing water. An end of the filter casing 661 is closed by a detachably attachable cap 663 so that the lint filter 662 can be cleaned or replaced by detaching the cap 663.

A drain pipe 664 is connected to the other end of the filter casing 661. The drained water having passed through the filter 662 is drained out of the body 610 through the drain pipe 664. A drain valve 665 is provided in the middle of the drain pipe 664.

An air trap 671 is connected to the filter casing 661. A water level sensor 673 is provided at the upper end of a connecting pipe 672 extending from the air trap 671. The water level sensor 673 moves a magnetic substance within a coil in accordance with a pressure change in the air trap 671, detects the resultant inductance change of the coil as an oscillation frequency change, and reads the water level from the oscillation frequency change. The water level that is read here is the water level in the drum 630.

An operation panel 616 is provided on the top of the front surface of the body 610. As shown in FIG. 1, a display 682 having a liquid crystal panel, a buzzer and the like and an operation switch section 684 including operation buttons of various switches are disposed on the operation portion 616.

Reference numeral 690 shown in FIG. 2 represents a controller with a microcomputer as a main component. The controller 690, which includes a necessary storage such as a hard disk, also serves as storing means. The controller 690, which is disposed close to the operation panel 616 in the body 610, receives an operation instruction from the user through the operation switch section 684, and provides an operation instruction to the motor 640, the water supply valve 50 and the drain valve 665. Moreover, the controller 690 provides a display instruction to the display 682. The controller 690 includes a driving circuit 120 (see FIG. 10) for driving an ion elution unit 100 described later.

The above-mentioned operation panel 616 is an input portion for the user to set a desired laundry washing mode. The controller 690 selects an individual operation in accordance with the laundry washing mode being set by the operation panel 616, and executes the selected operation. Examples of the individual operation include a washing operation, a rinsing operation, a spin-drying operation and a drying operation. Thus, the laundry washing process executed by the controller 690 comprises at least one of the washing operation, the rinsing operation, the spin-drying operation and the drying operation, or a combination thereof in accordance with the laundry washing mode.

(2. Operation of the Washing Machine)

Next, the operation of the slanted drum washing machine 601 having the above-described structure will be described.

First, the user opens the door 612, puts laundry into the drum 630, and puts a detergent into the detergent chamber 54 of the water supply mouth 53. When necessary, the user puts a finishing agent into the finishing agent chamber 55. The finishing agent may be put in the middle of the laundry washing process.

After the detergent addition preparation is made, the user closes the door 612, and operates the operation buttons of the operation switch section 684 of the operation panel 616 to select the laundry washing condition (laundry washing mode) Lastly, when the user pushes the start button, the laundry washing process corresponding to the laundry washing mode is performed in accordance with the flowcharts of FIGS. 4 to 7.

Figure 4:
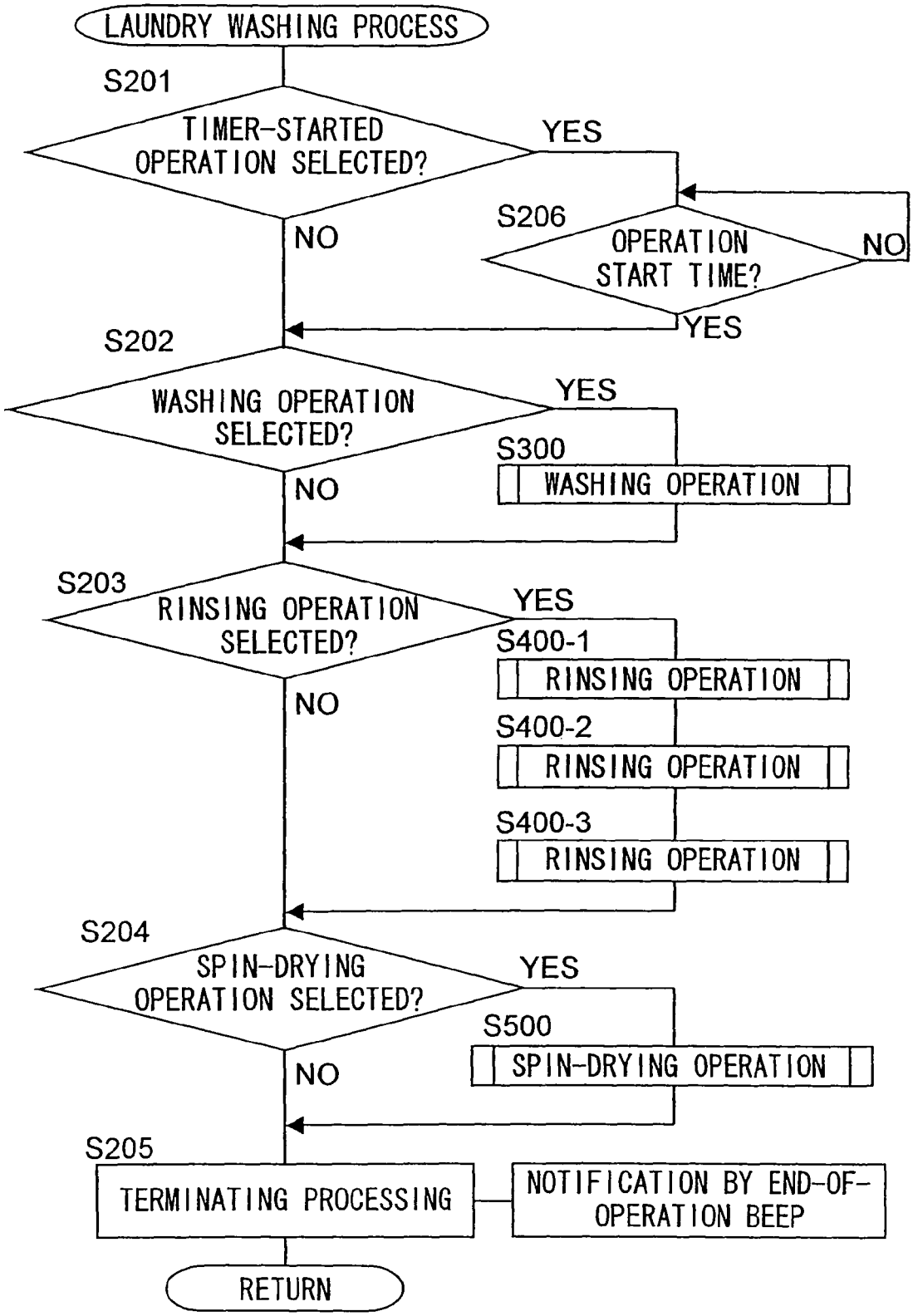
FIG. 4 is a flowchart showing the entire flow of the laundry washing process of the washing machine.

FIG. 4 is a flowchart of the entire laundry washing process. At step S201, it is determined whether a timer-started operation to start laundry washing at a set time is selected or not. If a timer-started operation is selected, the process proceeds to step S206. When it is not selected, the process proceeds to step S202.

When the process proceeds to step S206, whether the operation start time has come or not is determined. When the operation start time has come, the process proceeds to step S202.

At step S202, whether the washing operation is selected or not is determined. When it is selected, the process proceeds to step S300. The contents of the washing operation of step S300 will be described later with reference to the flowchart of FIG. 5. After the washing operation is finished, the process proceeds to step S203. When the washing operation is not selected at step S202, the process proceeds directly to step S203.

At step S203, whether the rinsing operation is selected or not is determined. When it is selected, the process proceeds to S400. The contents of the rinsing operation of step S400 will be described later with reference to the flowchart of FIG. 6. After the rinsing operation is finished, the process proceeds to step S204. When the rinsing operation is not selected at step S204, the process proceeds directly to step S204.

The rinsing operation may be performed a plurality of times. In FIG. 4, the rinsing operation is performed three times, and the step numbers of the times of the operation are denoted by branch numbers "S400-1," "S400-2 " and "S400-3," respectively. The number of times of the rinsing operation can be arbitrarily set by the user. When the metal ions and the finishing agent are added in different rinsing operations, the rinsing operation is necessarily performed at least twice. The metal ions and a different finishing agent may be simultaneously added in the same rinsing operation. In this case, the necessary number of times of the rinsing operation is at least one.

At step S204, whether the spin-drying operation is selected or not is determined. When it is selected, the process proceeds to S500. The contents of the spin-drying operation of step S500 will be described later with reference to the flowchart of FIG. 7. After the spin-drying operation is finished, the process proceeds to step S205. When the spin-drying operation is not selected at step 204, the process proceeds directly to step S205.

At step S205, terminating processing by the controller 690, in particular, an arithmetic unit (microcomputer) included therein is automatically executed according to the procedure. In addition, the controller 690 notifies the user of the completion of the laundry washing process with an end-of-operation beep. After all the processing is finished, the slanted drum washing machine 601 returns to stand-by state in preparation for the next laundry washing process.

When the drying operation is selected, the drying operation is performed after step S204. In the drying operation, the laundry is dried, for example, by supplying hot air into the drum 630. The hot and humid air discharged from the drum 630 is cooled by cooling water, and the moisture in the air is converted into water. That is, the drying operation adopts a water-cooling dehumidification method. The water cooled by the cooling water is drained out of the machine through the drain pipe 664.

(3. Details of the Laundry Washing Operations)

Next, of the above-mentioned laundry washing operations, details of the individual operations of washing, rinsing and spin-drying will be described with reference to FIGS. 5 to 7.

(3-1. Washing Operation)

First, the washing operation will be described.

Figure 5:
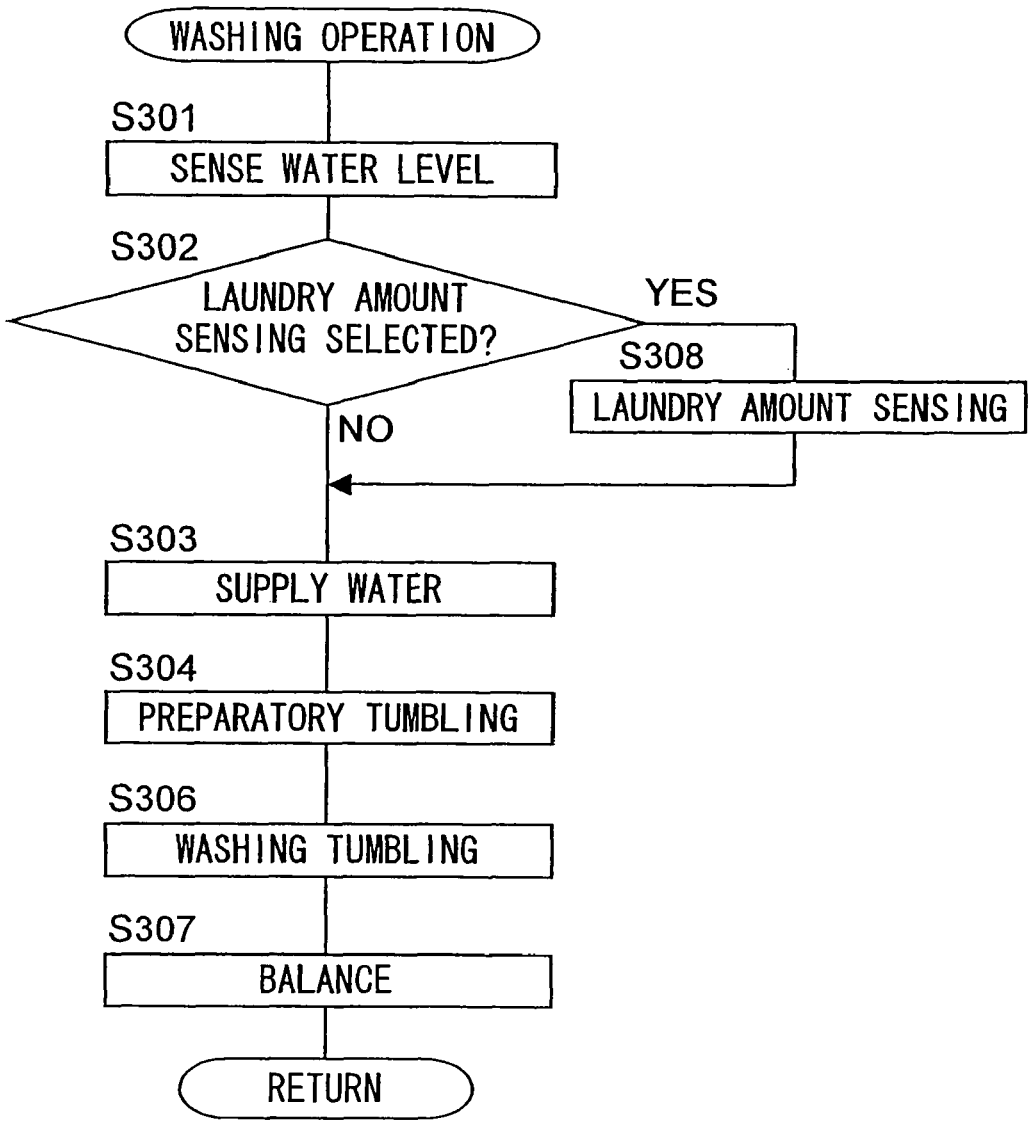
FIG. 5 is a flowchart showing the details of a washing operation in the laundry washing process.

FIG. 5 is a flowchart of the washing operation. At step S301, the data on the water level in the drum 30 sensed by the water level sensor 673 is captured. At step S302, whether laundry amount sensing is selected or not is determined. When the selection of the laundry amount sensing is selected, the process proceeds to step S308. At step S308, the laundry amount sensing to measure the amount of laundry based on the rotation load of the drum 630 is performed. After the laundry amount sensing, the process proceeds to step S303. When the laundry amount sensing is not selected at step S302, the process proceeds directly to S303.

At step S303, the main water supply valve 50*a* is opened, and water is poured into the drum 630 through the main water supply pipe 52*a* and the water supply mouth 53 (precisely, water is poured into the water tub 620, and the water enters the drum 630 through the dewatering holes 633). The detergent being put in the detergent chamber 54 of the water supply mouth 53 mixes with the water and enters the washing tub 30 together with the water. At this time, the drain valve 665 is closed. When the water level sensor 673 detects the set water level, the main water supply valve 50*a* is closed. Then, the process proceeds to step S304.

At step S304, preparatory tumbling is performed. In the preparatory tumbling, the drum 630 is rotated at low speed to cause the laundry to be raised out of the water and dropped into the water again so that the laundry absorbs an ample amount of water. Moreover, the air trapped in parts of the laundry is allowed to escape.

After the preparatory tumbling, the process shifts to step S306. At step S306, the drum 630 is rotated in a pattern of washing tumbling to raise the laundry high and then, drop it. The shock caused when the laundry is dropped causes a jet stream of water between the fibers of the laundry, whereby the laundry is washed.

After the elapse of the washing tumbling period, the process proceeds to step S307. At step S307, the drum 630 is rotated gently. When the drum 630 is rotated gently, before raised to a high position, the laundry separates from the drum 630 at a low position to drop.

When dropped from a high position, the laundry strikes hard against the inner wall of the drum 630, and sticks to the inner wall. Consequently, imbalance is not readily corrected when the drum 630 starts high-speed spin-drying rotation.

On the other hand, when separated from the inner wall of the drum 630 at a low position, the laundry rather rolls than strikes hard, so that the laundry piles up comparatively softly. In this state, the laundry easily scatters in every direction when the drum 630 starts high-speed spin-drying rotation. That is, balance is easily achieved. For this reason, the drum 630 is gently rotated to disentangle the laundry in preparation for spin-drying rotation.

(3-2. Rinsing Operation)

Next, the contents of the rinsing operation will be described with reference to the flowchart of FIG. 6.

While the spin-drying operation of step S500 (referred to as intermediate spin-drying operation here because it is a spin-drying operation performed in the rinsing operation) is executed first, this will be described with reference to the flowchart of FIG. 7. After the intermediate spin-drying at step S500, the process proceeds to step S401. At step S401, the main water supply valve 50*a* is opened, and water is supplied up to the set water level.

After the water supply, the process proceeds to step S402. At step S402, preparatory tumbling is performed. The preparatory tumbling is similar to the operation performed at step S304 of the washing operation.

After the preparatory tumbling, the process proceeds to step S405. The drum 630 is rotated in a pattern of rinsing tumbling in accordance with the setting by the user. The drum 630 causes, by the rotation, the laundry to soak in the water, rise up and drop down. Thereby, the laundry is rinsed.

After the elapse of the rinsing tumbling period, the process shifts to step S406. At step S406, the drum 630 is rotated gently to disentangle the laundry in preparation for spin-drying rotation.

While in the above description, "stored-water rinsing" is performed in which rinsing is performed with rinsing water stored in the drum 630, "poured-water rinsing" in which new water is always supplied or "shower rinsing" in which water is showered on the laundry may be performed.

(3-3. Spin-drying Operation)

Next, the contents of the spin-drying operation will be described with reference to the flowchart of FIG. 7.

First, at step S501, the drain valve 665 is opened. Thereby, the washing water or the rinsing water in the drum 630 is drained through the drain valve 665. The drain valve 665 remains open during the spin-drying operation.

When a predetermined time has elapsed and the laundry is mostly dewatered, the drum 630 starts spin-drying rotation. When the drum 630 is rotated at high speed, the laundry is pressed against the inner wall of the drum 630 by the centrifugal force. Thereby, the water contained in the laundry gathers on the inner circumferential wall of the drum 630 and is released through the dewatering holes 633. The washing water separated from the dewatering holes 633 is struck against the inner surface of the water tub 620, and flows down to the bottom of the water tub 620 along the inner surface of the water tub 620. Then, the water is drained out of the casing 610 through the drain outlet 623, the drain pipe 660, the filter casing 661, the drain pipe 664 and the drain valve 665.

Figure 7:
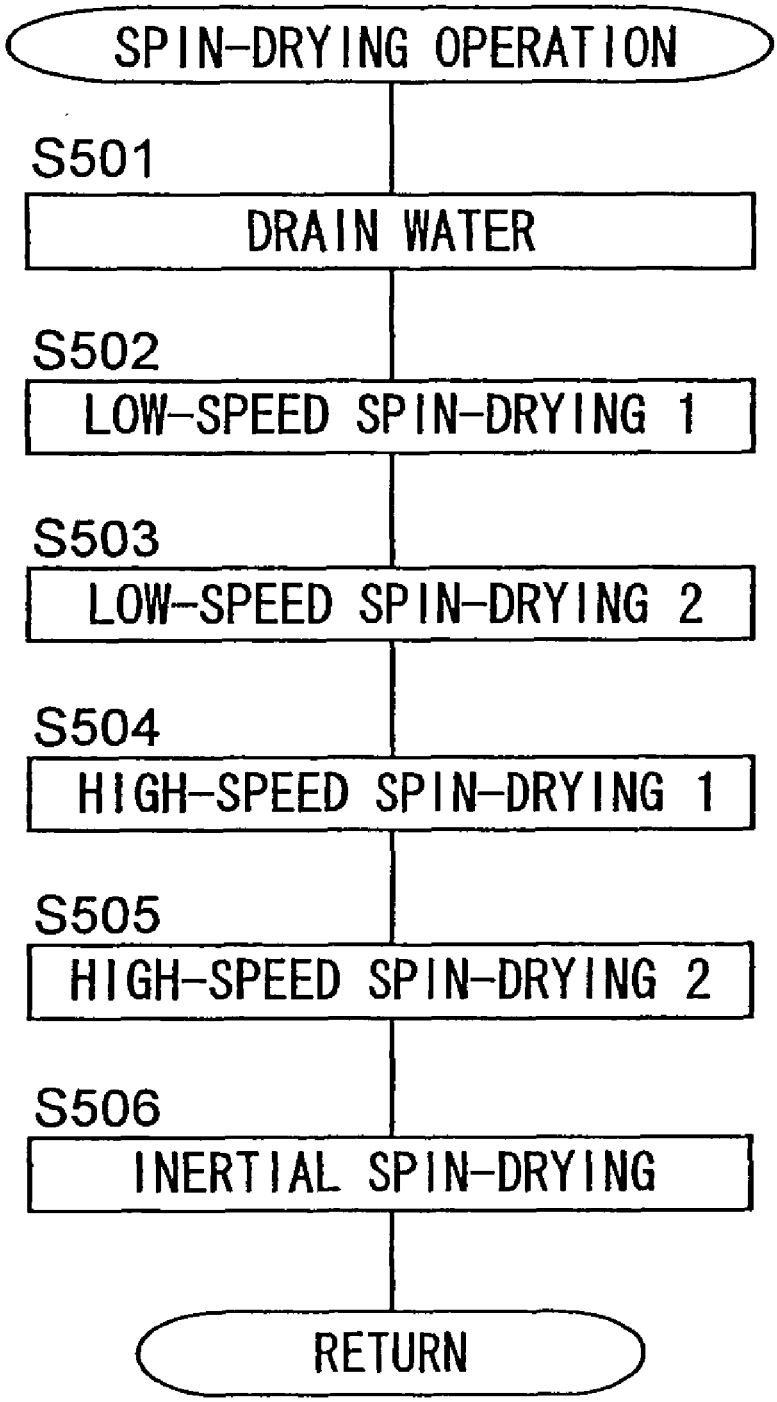
FIG. 7 is a flowchart showing the details of a spin-drying operation in the laundry washing process.

In the sequence of FIG. 7, after spin-drying at a comparatively low speed is performed at step S502 and step S503, spin-drying at a high speed is performed at step S504 and step S505. After step S505, the process shifts to step S506. At step S506, power supply to the motor 640 is stopped, and the drum 630 is inertially rotated, without the brake being applied, so as to stop spontaneously.

(4. Structure of the Ion Elution Unit)

Next, the ion elution unit 100 provided in the slanted drum washing machine 601 will be described.

As shown in FIG. 3, the ion elution unit 100 (ion eluting means) is disposed in the middle of the main water supply pipe 52*a*, that is, between the main water supply valve 50*a* and the detergent chamber 54. Hereinafter, the structure and function of the ion elution unit 100 and the role that it plays by being provided in the slanted drum washing machine 601 will be described with reference to FIGS. 8 and 9.

Figure 8:
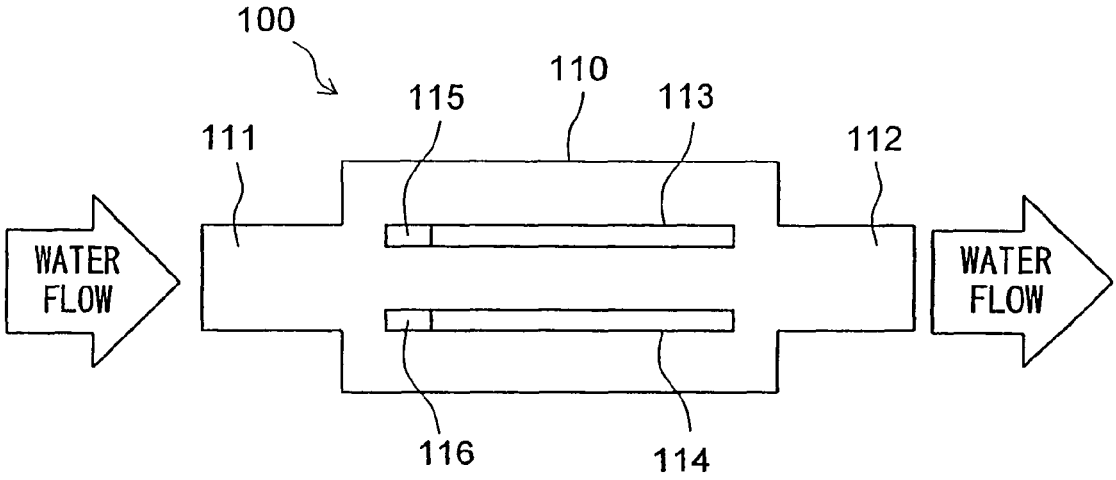
FIG. 8 is a horizontal cross-sectional view showing the schematic structure of an ion elution unit provided in the washing machine.
Figure 9:
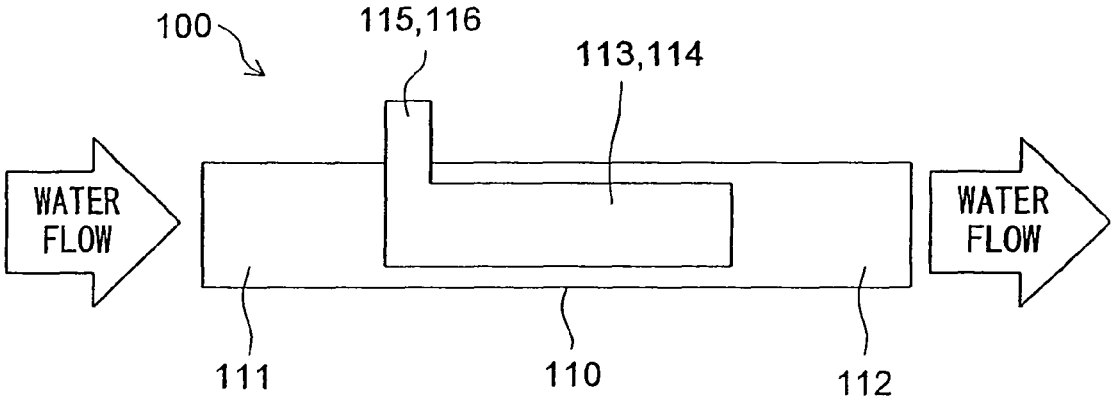
FIG. 9 is a vertical cross-sectional view showing the schematic structure of the ion elution unit.

FIGS. 8 and 9 are schematic cross-sectional views of the ion elution unit 100. FIG. 8 is a horizontal cross-sectional view thereof, and FIG. 9 is a vertical cross-sectional view thereof. The ion elution unit 100 has a casing 110 made of an insulating material such as synthetic resin. The casing 110 has a water inlet 111 at its one end, and has a water outlet 112 at its other end. In the casing 110, two plate-shaped electrodes 113 and 114 are disposed parallel to each other with a predetermined spacing in between. The electrodes 113 and 114 are made of a metal from which the metal ions having an antibacterial property derives, that is, silver, copper or zinc.

The electrodes 113 and 114 have terminals 115 and 116 at their one ends, respectively. It is desirable that the electrode 113 and the terminal 115, and the electrode 114 and the terminal 116 be integrated with each other. When these cannot be integrated, the junctions between the electrodes and the terminals and the terminal portion in the casing 110 are coated with a synthetic resin so as not to be in contact with water, thereby preventing electrolytic corrosion. The terminals 115 and 116 protrude out of the casing 110 to connect with the driving circuit 120 (see FIG. 10) in the controller 690.

In the casing 110, water flows parallel to the direction of the length of the electrodes 113 and 114. When a voltage is applied to the electrode 113 and 114 while water is flowing in the casing 110, metal ions of the constituent metal of the electrodes are eluted from the anode side of the electrodes 113 and 114. The electrodes 113 and 114 are, for example, silver plates each measuring 2 cm by 5 cm and having a thickness of approximately 1 mm, and are disposed with a spacing of approximately 5 mm in between.

It is desirable that the constituent metal of the electrodes be silver, copper, zinc or an alloy thereof. Silver ions eluted from silver electrodes and zinc ions eluted from zinc electrodes are excellent in the sterilizing effect, and copper ions eluted from copper electrodes are excellent in the antifungal effect. On the other hand, from alloys thereof, since ions of the constituent metals can be eluted at the same time, excellent sterilizing and antifungal effects can be obtained.

Because of the structure of the ion elution unit 100, the controller 690 (driving circuit 120) described later is capable of selecting whether to elute metal ions or not based on the presence or absence of the voltage application to the electrodes 113 and 114. Moreover, the controller 690 is capable of controlling the metal ion elution amount, in other words, the metal ion concentration in the metal ion added water by controlling the current passed through the electrodes 113 and 114 and the voltage application time. Therefore, compared to a method in which metal ions are eluted from a metal ion carrier such as zeolite, this method is excellent in usability because selection of whether to add metal ions or not and the adjustment of the metal ion concentration can be all electrically performed. Further, the controller 690 is capable of controlling the metal ion concentration in the metal ion added water by changing the amount of water supplied to the ion elution unit 100 per unit time (the water supply flow amount, the water supply speed) by adjusting the opening and closing amount of the water supply valve 50.

This metal ion concentration adjustment will be described in more detail.

The amount of metal elution from the electrodes 113 and 114 per unit time is approximately proportional to the current value. Therefore, by passing a large current through the electrodes 113 and 114, the metal ion concentration in the metal ion added water can be easily made high.

When the value of the current passed through the electrodes 113 and 114 is fixed, since the metal elution amount per unit time is fixed, a larger amount of metal can be eluted by increasing the time for which the current is passed (voltage application time). Specifically, when the ion elution unit 100 is disposed on the water supply path, until metal of a predetermined mass calculated from a predetermined water amount and a predetermined concentration is eluted, metal elution is performed while water is supplied, and when metal of the predetermined mass is eluted, the metal elution is stopped, and water supply is continued until the predetermined water amount is reached.

By thus increasing the time for which metal elution is performed, the metal elution amount can be increased to increase the metal concentration. However, since the time for which current is passed through the electrodes 113 and 114 cannot exceed the time required for the washing machine 601 to supply water to the drum 630, it is necessary to control the water supply flow amount (water supply speed) so as to be appropriate. For example, in a case where the current value is 29 mA, when the water supply speed is 19 L/min, the metal ion concentration can be increased to only 95 ppb at the maximum. However, by setting the water supply speed to 10 L/min, the metal ion concentration can be increased to 180 ppb at the maximum.

While the water supply amount varies among households, this causes no problem because the maximum water supply amount can be controlled by selection of the water supply valve and when the flow amount is lower than that, the time required for water supply is longer than that and the concentration can be more easily increased.

(5. Structure of the Driving Circuit of the Ion Elution Unit)

Next, the driving circuit 120 that drives the ion elution unit 100 will be described.

Figure 10:
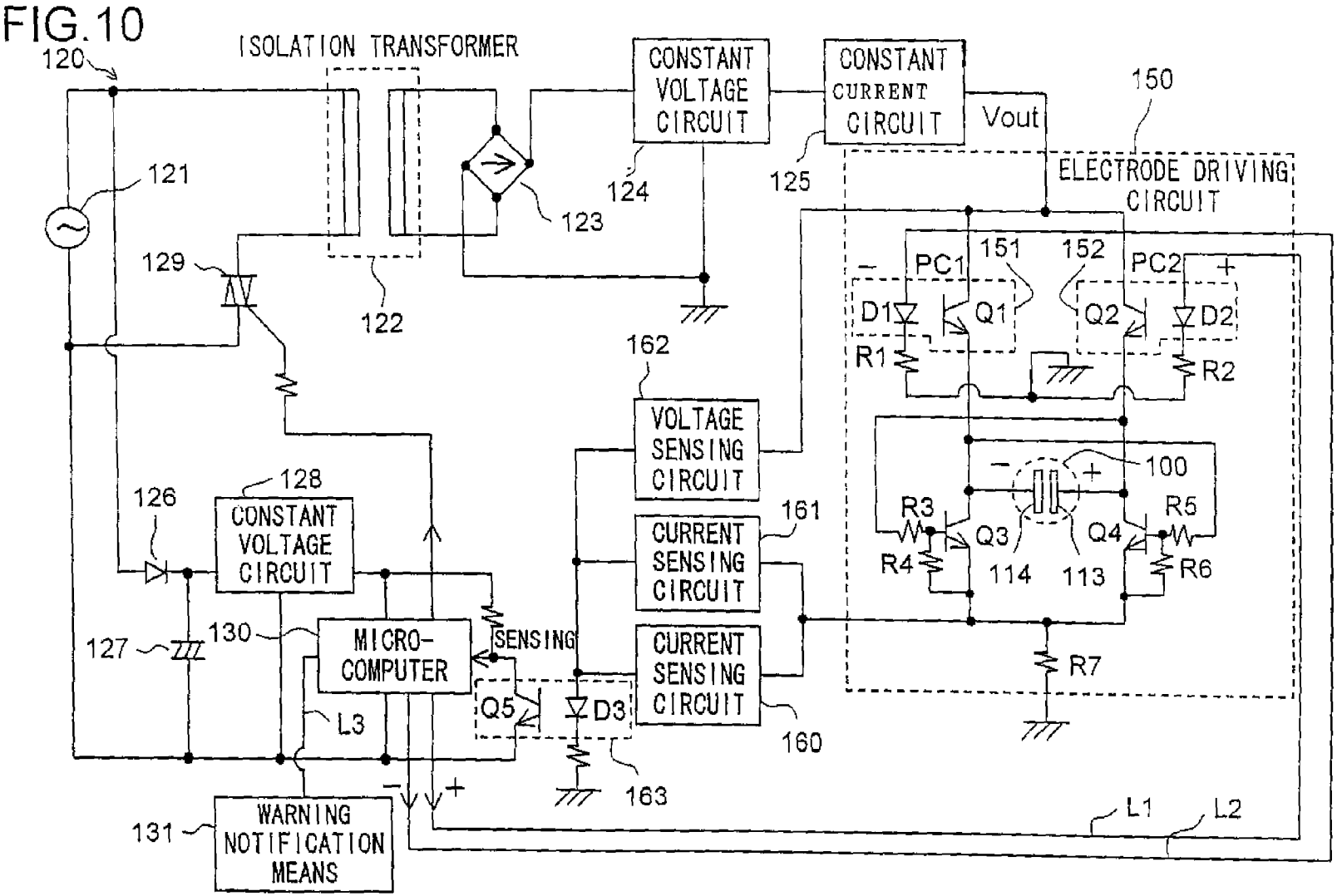
FIG. 10 is an explanatory view showing the schematic structure of a driving circuit for driving the ion elution unit.

FIG. 10 is an explanatory view showing the schematic structure of the driving circuit 120. A transformer 122 is connected to a commercial electric power source 121, and the transformer 122 steps down a voltage of 100 V to a predetermined voltage. The output voltage of the transformer 122 is rectified by a full-wave rectifier circuit 123, and is then converted into a constant voltage by a constant voltage circuit 124. To the constant voltage circuit 124, a constant current circuit 125 is connected. The constant current circuit 125 operates so as to supply a constant current to an electrode driving circuit 150 described later irrespective of variations in the value of the resistance through the electrode driving circuit 150.

To the commercial electric power source 121, a rectifying diode 126 is connected in shunt with the transformer 122. The output voltage of the rectifying diode 126 is smoothed by a capacitor 127, is then converted into a constant voltage by a constant voltage circuit 128, and is then supplied to a microcomputer 130. The microcomputer 130 controls the starting of a triac 129 connected between one end of the primary coil of the transformer 122 and the commercial electric power source 121.

The electrode driving circuit 150 comprises NPN-type transistors Q1 to Q4, diodes D1 and D2, and resistors R1 to R7 which are interconnected as shown in the figure. The transistor Q1 and the diode D1 form a photocoupler 151, and the transistor Q2 and the diode D2 form a photocoupler 152. That is, the diodes D1 and D2 are photodiodes, and the transistors Q1 and Q2 are phototransistors.

Assuming now that the microcomputer 130 applies a high-level voltage to a line L1 and a low-level voltage or OFF (zero voltage) to a line L2, the diode D2 turns on, and this causes the transistor Q2 to turn on. When the transistor Q2 turns on, current flows through the resistors R3, R4, and R7, and this causes a bias to be applied to the base of the transistor Q3, so that the transistor Q3 turns on.

On the other hand, since the diode D1 is off, the transistors Q1 is off, and the transistor Q4 is also off. In this state, current flows from the anode-side electrode 113 to the cathode-side electrode 114. Consequently, in the ion elution unit 100, metal ions as positive ions, and negative ions are generated.

When current is passed through the ion elution unit 100 in one direction for a long time, the electrode 113 which is on the anode side in FIG. 10 is depleted, and on the electrode 114 which is on the cathode side, impurities such as calcium in water are deposited in the form of scales. Moreover, chloride and sulfide of the constituent metal of the electrodes are generated on the surfaces of the electrodes. Since this degrades the performance of the ion elution unit 100, in the present embodiment, the electrode driving circuit 150 is structured so as to be capable of being operated with the electrode polarity being reversed.

In reserving the electrode polarity, the microcomputer 130 switches the control so as to reverse the voltages of the lines L1 and L2 so that current flows in the opposite direction through the electrodes 113 and 114. In this case, the transistors Q1 and Q4 are on, and the transistors Q2 and Q3 are off. The microcomputer 130 has a counter function, and performs the above-described switching every time a predetermined count is reached.

When a situation occurs such that the value of the current flowing between the electrodes is decreased by a change of the resistance in the electrode driving circuit 150, in particular, a change of the resistance of the electrodes 113 and 114, the constant current circuit 125 increases its output voltage to prevent the current reduction. However, when the cumulative time of use becomes long, the ion elution unit 100 reaches its end of life. When this happens, the current reduction cannot be prevented even if the electrode polarity is reversed, switching is made to an electrode cleaning mode to forcibly remove the impurities adhering to the electrodes by setting the time for which the polarity is a specific one so as to be longer than that in normal times, or the output voltage of the constant current circuit 125 is increased.

Therefore, in the present circuit, the current flowing between the electrodes 113 and 114 of the ion elution unit 100 is monitored by a voltage caused across the resistor R7, and when the current reaches a predetermined minimum current value, this is sensed by current sensing means. A current sensing circuit 160 is the current sensing means. Information indicating that the minimum current value is sensed is transmitted from a photodiode D3 constituting a photocoupler 163 to the microcomputer 130 through a phototransistor Q5. The microcomputer 130 drives notification means through a line L3 to cause it to make a predetermined warning notification. Warning notification means 131 is the notification means. The warning notification means 131 is disposed on the operation panel 616 or the controller 690.

For accidents such as a short circuit in the electrode driving circuit 150, current sensing means for detecting that the current becomes not less than a predetermined maximum value is provided, and based on the output of the current sensing means, the microcomputer 130 drives the warning notification means 131. A current sensing circuit 161 is the current sensing means. Further, when the output voltage of the constant current circuit 125 becomes not more than the predetermined minimum value, a voltage sensing circuit 162 senses this, and at the same time, the microcomputer 130 drives the warning notification means 131.

(6. Metal Ion Elution and Addition Operation)

Next, the operation of elution and addition of the metal ions generated by the ion elution unit 100 will be described.

Figure 11:
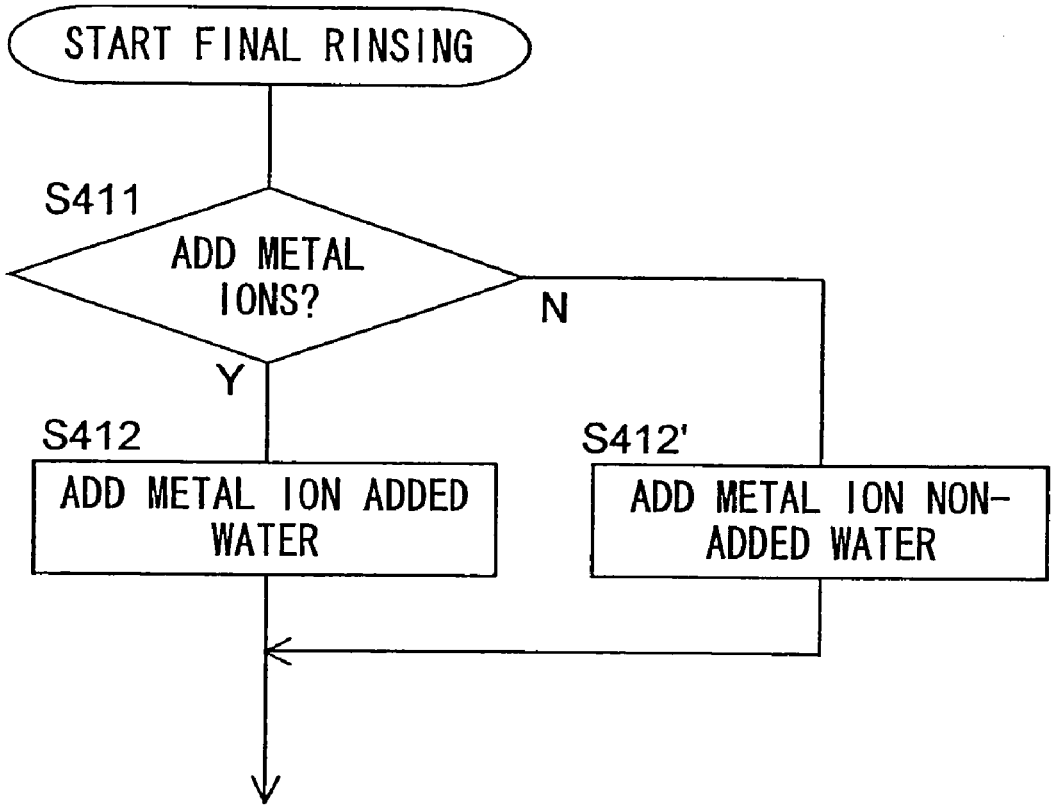
FIG. 11 is a flowchart showing the sequence of the elution of the metal ions from the ion elution unit, and the addition of metal ion added water.

FIG. 11 is a flowchart showing the sequence of metal ion elution and addition. The sequence of FIG. 11 is executed, for example, in the stage of step S401 (water supply) of the flow of the rinsing operation of FIG. 6. That is, when rinsing is started, at step S411, it is determined whether "metal ion addition" is selected by a selection operation on the operation panel 616 or not. This determination step may be executed earlier. When "metal ion addition" is selected at step S411, the process proceeds to step S412, and when it is not selected, the process proceeds to step S412' described later.

At step S412, the main water supply valve 50*a* is opened, and a predetermined flow amount of water is poured through the ion elution unit 100. At the same time, the driving circuit 120 of the controller 690 applies a voltage between the electrodes 113 and 114 to cause ions of the constituent metal of the electrodes to be eluted into the water. At this time, the current flowing between the electrodes is direct current. The metal ion added water is added from the water supply mouth 53 into the drum 630.

The controller 690 adds a predetermined amount of metal ion added water, and when determining that the metal ion concentration of the rinsing water reaches a predetermined value, stops the voltage application to the electrodes 113 and 114.

When the metal ion added water is added, a finishing agent is also added. The finishing agent is added by opening the sub water supply valve 50*b* and pouring water into the finishing agent chamber 55 of the water supply mouth 53. When a finishing agent is put in the finishing agent chamber 55, the finishing agent is added into the washing tub 30 together with water from the siphon 57. Since the siphon effect is not produced until the water level in the finishing agent chamber 55 reaches a predetermined level, a liquid finishing agent can be held in the finishing agent chamber 55 until water is poured into the finishing agent chamber 55 when the time comes. In the present embodiment, an operation on the precondition that a finishing agent is always added is performed without the selection of the addition of a finishing agent being made. When the user intends not to add a finishing agent, no finishing agent is set in the finishing agent chamber 55.

However, in the present embodiment, the main water supply valve 50*a* and the sub water supply valve 50*b* are structured so as not to be opened at the same time. This is because if these are opened at the same time, the total water supply amount is large and this can cause overflow of water from the detergent addition box.

Figure 12:
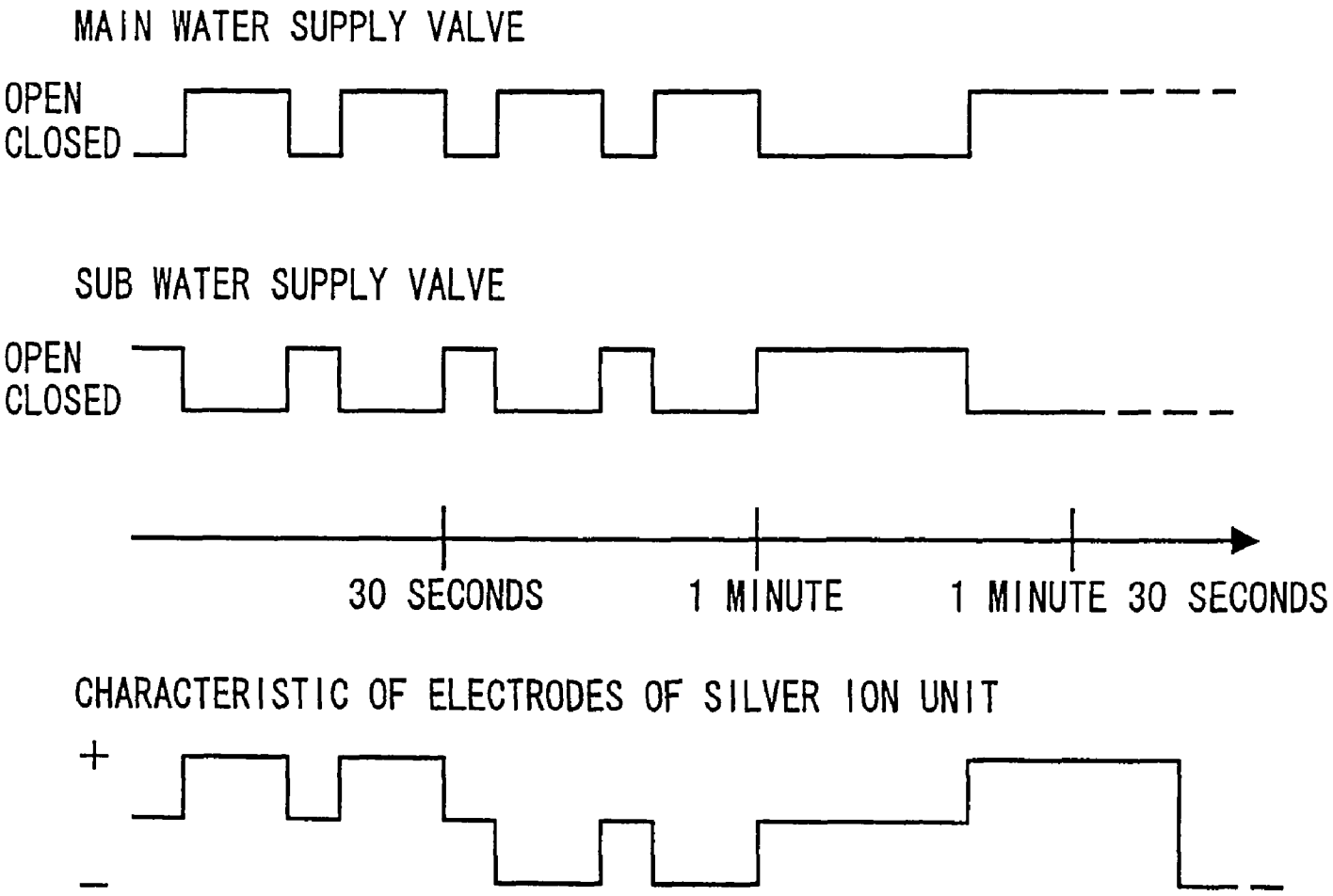
FIG. 12 is a timing chart showing the timing of opening and closing of a main water supply valve and a sub water supply valve and the timing of voltage application to electrodes of the ion elution unit in the washing machine.

Specifically, as shown in FIG. 12, the controller 690 first repeats four times an operation to open only the sub water supply valve 50*b* for 5 seconds and then open only the main water supply valve 50*a* for 10 seconds, then, opens only the sub water supply valve 50*b* for 20 seconds, and then, opens only the main water supply valve 50*a* until a predetermined water level is sensed. With this operation, the finishing agent can be stably added without water overflowing from the detergent addition box.

At this time, as shown in the figure, the controller 690 performs the voltage application to the electrodes 113 and 114 of the ion elution unit 100 only when the main water supply valve 50*a* is open. This is because the ion elution unit 100 is disposed on the water supply path from the main water supply valve 50*a*. That is, when the main water supply valve 50*a* is closed, hardly any water is present in the ion elution unit 100, and when a voltage is applied under that condition, how much current flows is not known and consequently, the metal ion elution amount is unknown, which is undesirable.

Moreover, in the present embodiment, the power source of the driving circuit 120 of the controller 690 of the ion elution unit 100 and the power source of the solenoid valve of the main water supply valve 50*a* are in shunt with each other so as to branch from the same power source. By separately providing the power sources like this, the power on and off can be independently controlled, so that the voltage application to the ion elution unit 100 can be more reliably prevented from being performed other than when the main water supply valve 50*a* is open.

Moreover, in the present embodiment, as shown in the figure, the controller 690 applies a voltage to the electrodes 113 and 114 so that their polarities are reversed every 20 seconds. In the figure, a case where one electrode becomes an anode is represented by +, and a case where it becomes a cathode is represented by −.

The reasons why such electrode polarity reversal control is performed are as follows:

① Since metal ions are eluted from the anode, if one electrode is always an anode, only that electrode is depleted.

② Scales made of calcium or the like are apt to be deposited on a cathode. Although these scales can be removed by changing the scale deposited electrode to an anode, when one electrode is always a cathode, the amount of scale deposit is large, so that it is difficult to remove the scales even if the electrode is changed to an anode.

To avoid these problems, in the present embodiment, the control to periodically reverse the electrode polarity is performed.

On the other hand, at step S412', metal ion addition is not performed. That is, although step S412' is the same in that the controller 690 opens the main water supply valve 50*a* and a predetermined flow amount of water is poured through the ion elution unit 100, the voltage application to the electrodes 113 and 114 in the ion elution unit 100 is not performed. Except this, step S412' is the same as step S412.

(7. Imbalance Correction)

Next, imbalance correction in the spin-drying operation will be described.

Figure 13:
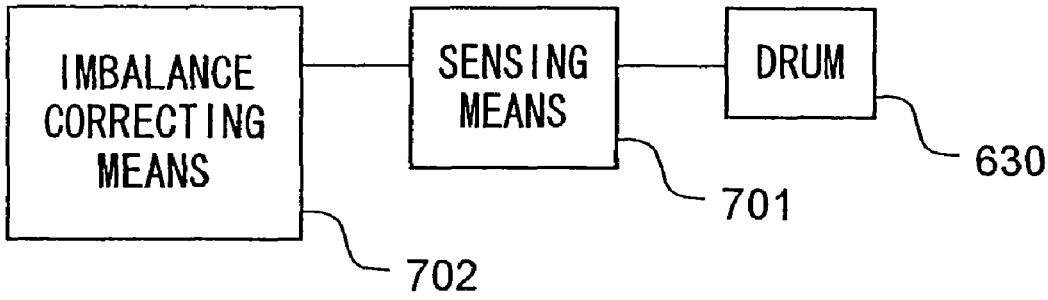
FIG. 13 is a block diagram showing the structure for correcting imbalance in the drum at the time of spin-drying in the washing machine.

As shown in FIG. 13, the washing machine 601 of the present embodiment has sensing means 701 and imbalance correcting means 702.

The sensing means 701, which senses imbalance when the drum 630 is rotated, comprises, for example, physical sensing means such as a touch sensor, a shock sensor or an acceleration sensor, or sensing means in the form of software such as analyzing the voltage/current pattern of the motor.

The imbalance correcting means 702, when the sensing means 701 senses imbalance at the time of spin-drying rotation of the drum 630 performed after metal ion added water is supplied to the drum 630, corrects the imbalance by performing a processing different from that performed when imbalance is sensed in a case where no metal ion added water is supplied. While the imbalance correcting means 702 may comprise, for example, the controller 690, it may comprise a different microprocessor. Moreover, in the present embodiment, the above-mentioned different processing is balance correction rinsing to supply the metal ion added water to the drum 630 and perform agitation.

In the spin-drying operation, when the sensing means 701 senses imbalance, in a case where that is the first sensing of imbalance, the imbalance correcting means 702 disentangles the laundry by performing tumbling without performing the supply of metal ion added water to the drum 630 as balance correction, and again starts spin-drying. When the sensing means 701 again senses imbalance in the spin-drying performed after balance correction is performed once and balance correction is again required, the imbalance correcting means 702 disentangles the laundry by performing tumbling while supplying metal ion added water to the drum 630.

When metal ion added water is supplied to the drum 630 and the antibacterial treatment is performed on the laundry in the preceding rinsing operation, there is a possibility that some of the metal ions adhering to the laundry are lost because of the water supply to the drum 630 and this decreases the antibacterial property. However, the effect of entangling the laundry by supplying water is higher than the effect of enabling the antibacterial property of the laundry to be maintained by not supplying water, and the balance correction effect is high.

Therefore, the imbalance correcting means 702 uses metal ion added water also in the water supply at the time of balance correction, and prevents the reduction in the antibacterial property of the laundry by supplying the metal ion added water to the drum 630.

When metal ion addition is not selected before spin-drying is performed and no antibacterial treatment is performed at the time of rinsing, the imbalance correcting means 702 does not supply metal ion added water but supplies normal tap water to the drum 630 at the time of balance correction.

As described above, in the present embodiment, the imbalance correcting means 702 performs balance correction rinsing to supply metal ion added water to the drum 630 and perform agitation when imbalance correction is performed at the time of spin-drying rotation of the drum 630 after the antibacterial treatment. When imbalance is sensed in a case where no metal ion added water is supplied, imbalance correction is performed by supplying normal tap water as described above, whereas when the antibacterial treatment has already been performed, by performing, as described above, a processing different from that performed when no metal ion added water is supplied which processing is called balance correction rinsing, even if metal ions added to the laundry in the preceding antibacterial treatment are washed away, the metal ions having been washed away can be surely made up for by supplying metal ion added water in the succeeding imbalance correction. Thus, imbalance correction can be performed without any loss of the antibacterial effect added to the laundry in the preceding antibacterial treatment. That is, imbalance correction can be performed while the efficacy of the antibacterial treatment on the laundry is ensured.

Moreover, when the antibacterial treatment by metal ions has already been performed in the preceding rinsing operation, in the balance correction rinsing, the imbalance correcting means 702 may be set the amount of metal ion added water supply to the drum 630 so as to be smaller than that in the preceding operation (rinsing operation). This is because even if such control is performed, the metal ions lost in the water supply at the time of spin-drying can be sufficiently made up for by the supply of the metal ion added water in the balance correction rinsing.

That is, since metal ions of an amount necessary for delivering the antibacterial effect on the laundry have already been supplied in the preceding metal ion added water supplying operation (rinsing operation), it is unnecessary to re-supply metal ions of the amount necessary for delivering the antibacterial effect even if the amount washed away in the succeeding balance correction rinsing is considered. With this, it can be prevented that metal ions are washed away without being used for the antibacterial treatment on the laundry in the balance correction rinsing and useless metal ions appear.

For the same reason, when the antibacterial treatment by metal ions has already been performed in the preceding rinsing operation, in the balance correction rinsing, the imbalance correcting means 702 may be set the metal ion concentration of the metal ion added water supplied to the drum 630 so as to be smaller than that of the metal ion added water supplied in the preceding operation (rinsing operation).

The above-described balance correction is applicable to vertical washing machines. Moreover, the adjustment of the metal ion added water supply amount can be performed by the imbalance correcting means 702 that adjusts the opening and closing of the water supply valve 50.

(8. Setting of Silver Ion Concentration)

Next, the setting of the silver ion concentration of the metal ion added water generated by the ion elution unit 100 will be described.

In the slanted drum washing machine 601, since the amount of water used for laundry washing is smaller than that of vertical washing machines, if the silver ion concentration is equal to that of the vertical washing machine, the amount of silver ions used for the antibacterial treatment is smaller than that of vertical washing machines, so that the antibacterial treatment on the laundry cannot be made effective.

Therefore, in the present embodiment, a relationship between the silver ion concentration of the metal ion added water (first metal ion added water) used for the antibacterial treatment in the slanted drum washing machine 601 and the antibacterial effect on the laundry at that time was examined, thereby examining the silver ion concentration necessary for obtaining the antibacterial effect in the slanted drum washing machine 601.

The antibacterial effect was evaluated by a quantitative test method (bacterial liquid absorbing method) based on JIS (Japanese Industrial Standards) L1902:2002. More specifically, a bacterial liquid (Staphylococcus aureus) was inoculated on each of a cloth A1 having undergone normal rinsing at the time of laundry washing and a cloth A2 having undergone an antibacterial treatment (silver ion coating), and after these were held at a temperature of 37° C. for 18 hours, the number of bacteria on each cloth was counted. With the difference between the log fluctuation values thereof as bacteriostasis activation values, the antibacterial effect was evaluated based on the bacteriostasis activation value. Laundry washing was performed with the cloth load being 7 kg and the rinsing water amount being 30 L. For example, when the number of bacteria after 18 hours is $1.9\times10^7$/ml on the cloth A1 and $2.4\times10^6$/ml on the cloth A2, the bacteriostasis activation value is $\log(1.9\times10^7)-\log(2.4\times10^6)=0.9$. Table 1 shows the relationship between the silver ion concentration and the bacteriostasis activation value at this time.

TABLE 1

| Silver ion concentration (ppb) | 0 | 90 | 120 |
|---|---|---|---|
| Bacteriostasis activation value | 0.1 | 1.1 | 2.5 |

From the result of Table 1, it is found that the bacteriostasis activation value monotonously increases as the silver ion concentration monotonously increases. Moreover, it is generally recognized that the antibacterial effect is achieved when the bacteriostasis activation value is not less than 2.

Therefore, from Table 1, it can be said that the antibacterial effect is achieved when the silver ion concentration is not less than 120 ppb because the bacteriostasis activation value is not less than 2.5.

Figure 14:
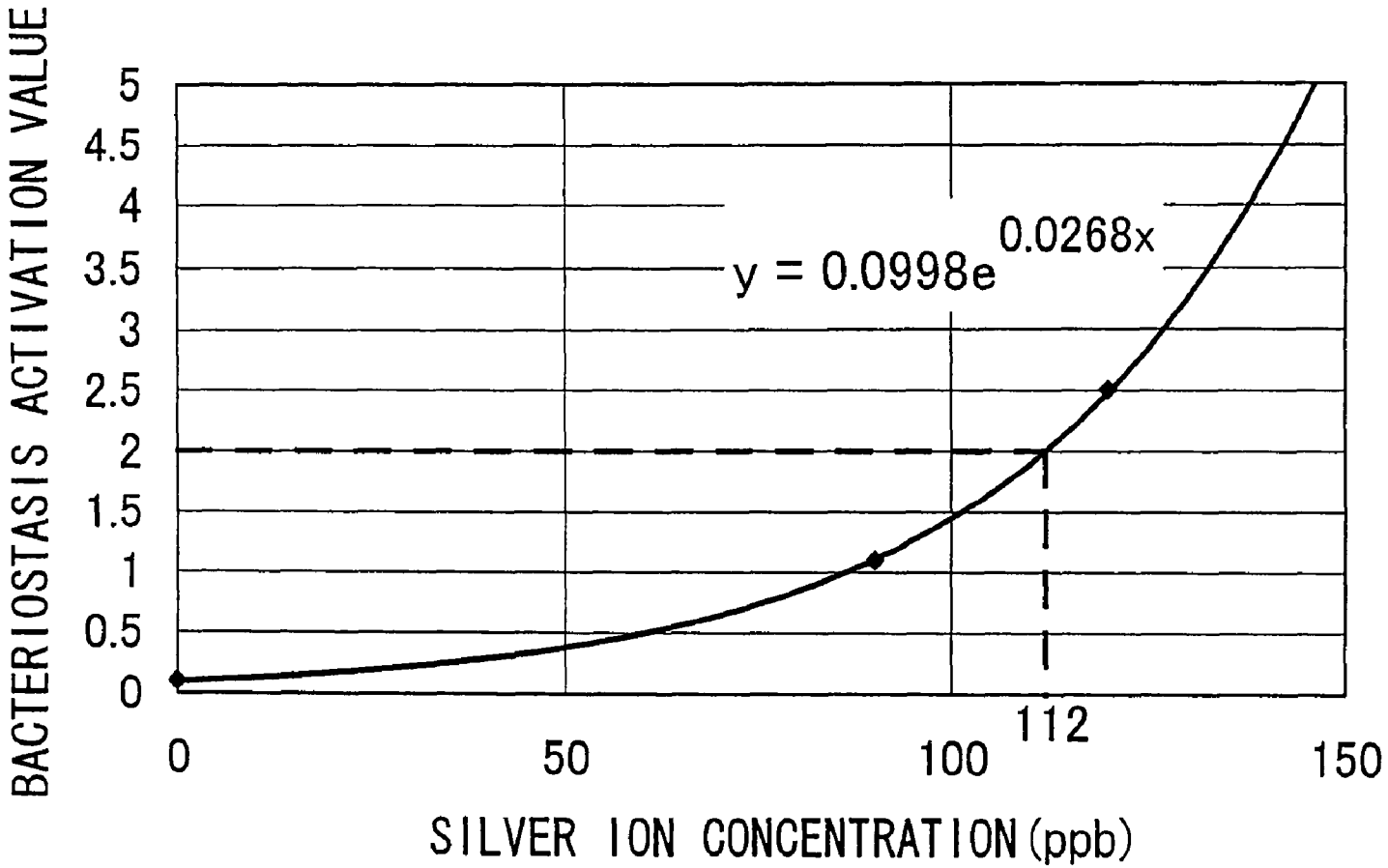
FIG. 14 is a graph showing a relationship between the silver ion concentration and the bacteriostasis activation value in the metal ion added water.

To further examine the relationship between the silver ion concentration and the bacteriostasis activation value, from the result of Table 1, the relationship between the silver ion concentration and the bacteriostasis activation value was graphed. FIG. 14 shows the relationship between the silver ion concentration and the bacteriostasis activation value which relationship is graphed based on the result of Table 1.

As shown in FIG. 14, when the horizontal axis (x-axis) represents the silver ion concentration and the vertical axis (y-axis) represents the bacteriostasis activation value, it is found that the curved line smoothly connecting three points whose coordinates are the silver ion concentration and the bacteriostasis activation value of Table 1 can be approximated by $y=0.0998 \exp(0.0268x)$ which is a monotonously increasing function. Obtaining from this function the silver ion concentration where the bacteriostasis activation value is 2, that is, the value of x when y=2, x=112.

Therefore, since it is recognized that the antibacterial effect is achieved when the bacteriostasis activation value is not less than 2, from FIG. 14, it can be said that the antibacterial effect is achieved when the silver ion concentration is not less than 112 ppb.

Moreover, a test in a case where the sensing means 701 senses imbalance at the time of spin-drying and balance correction by the imbalance correcting means 702 is performed was also performed. While the water supply amount at the time of balance correction was 12.4 L and the concentration was 48 ppb, the bacteriostasis activation value was held at not les than 2, and it was confirmed that the antibacterial property was maintained.

Moreover, for the washing machine 601 of the same structure, the antibacterial property for diphtheroids was also performed with the silver ion concentration being 120 ppb, the cloth load being 7 kg and the rinsing water amount being 30 L. As the evaluation method, with the bacteria changed to Corynebacteriumxerosis which is a kind of diphtheroids, a test was performed with reference to the quantitative test method (bacterial liquid absorbing method) based on JIS (Japanese Industrial Standards) L1902:2002. As a result, the logarithmic value of the difference in the number of bacteria after 18 hours between a cloth having undergone the antibacterial treatment (silver ion coating) and a control cloth determined by the bacterial liquid absorbing method of JIS L1902 was 2.1.

According to the bacterial liquid absorbing method of JIS L1902, although the bacteria (*Staphylococcus aureus*) are different from *Corynebacterium xerosis*, the antibacterial property is regarded as being obtained when the logarithmic value of the difference in the number of bacteria is not less than 2.0. Moreover, in JIS Z2801 and a test to measure the antibacterial performance and the disinfection performance such as a "criterion for use of terms associated with suppression of bacteria and the like" of the Home Electric Appliances Fair Trade Conference, that the logarithmic value of the difference in the number of bacteria is not less than 2.0 is also an index of the evaluation of the antibacterial power and the disinfecting power. Therefore, from the above-mentioned test result, it can be said that the antibacterial power for diphtheroids is also obtained under the above-mentioned condition.

On the other hand, the laundry was repetitively rinsed with water with a silver ion concentration of more than 900 ppb (metal ion added water), and although no change was recognized on the appearance of the laundry when the rinsing was repeated three times, the reflectance after sun drying was lower by 3% than that before rinsing when the rinsing was performed five times. It is considered that this is because black discolored substances derived from a silver compound adhere to the laundry. On white laundry, the adhesion of such blackened substances is conspicuous, and even on laundry that is not white, blackened substances can become conspicuous when the laundry is repetitively washed. From this, it can be considered that the upper limit of the silver ion concentration is 900 ppb.

From the above, in the slanted drum washing machine 601, it is desirable that the silver ion concentration in the metal ion added water to which metal ions (silver ions) eluted from the ion elution unit 100 are added be not less than 112 ppb and not more than 900 ppb and it is more desirable that it be not less than 120 ppb and not more than 900 ppb.

As described above, the slanted drum washing machine 601 of the present embodiment is a washing machine having the ion elution unit 100 that elutes metal ions from the electrodes 113 and 114 and adds them to water, and the drum 630 disposed so that the rotation axis thereof is at an angle with respect to the vertical direction and in which laundry is put. The metal ions are silver ions, and the silver ion concentration of the metal ion added water (first metal ion added water) is not less than 112 ppb.

With this structure, since the amount of silver ions contained in the same amount of water is larger than, for example, that of a second metal ion added water (with a silver ion concentration of 3 to 50 ppb) used for the antibacterial treatment on the laundry in vertical washing machines, even in the slanted drum washing machine 601 designed to use a small amount of water, at least the necessary amount of silver ions (the amount of silver ions where the bacteriostasis activation value is not less than 2) for delivering the antibacterial effect on the laundry can be secured. Consequently, the antibacterial effect equal to or higher than that obtained in the antibacterial treatment in vertical washing machines can be obtained also in the slanted drum washing machine 601, so that the antibacterial effect can be surely delivered by surely performing the antibacterial treatment on the laundry.

In particular, when the silver ion concentration in the first metal ion added water is not less than 120 ppb, a larger amount of silver ions can be contained in the water than when the silver ion concentration is 112 ppb. Therefore, when the amount of first metal ion added water is the same as that when the silver ion concentration is 112 ppb, the antibacterial effect by silver ions can be further delivered compared to when the first metal ion added water having such a silver ion concentration (112 ppb ) is used. Moreover, since even when the amount of first metal ion added water is smaller than that when the silver ion concentration is 112 ppb, a silver ion amount equal to that can be secured, the amount of water can be further reduced while the antibacterial effect is obtained, so that water saving effect is obtained.

Moreover, in the slanted drum washing machines 601 of the present embodiment, the silver ion concentration in the first metal ion added water is not more than 900 ppb. With this structure, it can be prevented that a silver compound (blackened substance) is generated by an excessive silver ion amount and adheres to the laundry and this makes the laundry dirty.

Since a metal ion amount necessary for the antibacterial treatment can be secured even if there is a change in water amount by controlling the metal ion concentration as described above, the slanted drum washing machine 601 of the present embodiment can be expressed as follows:

The slanted drum washing machine 601 of the present embodiment is a washing machine having the laundry tub (drum 630) in which the laundry is put, and the ion elution unit 100 that elutes metal ions from the electrodes 113 and 114, adds them to water and supplies metal ion added water to the laundry tub. The controller 690 (controlling means) is provided that changes the metal ion concentration of the metal ion added water in accordance with the amount of metal ion added water supplied from the ion elution unit 100 to the drum 630.

For example, in a case where the amount of laundry is the same, when the amount of metal ion added water supplied to the drum 630 is decreased, the controller 690 increases the metal ion concentration of the metal ion added water, for example, to not less than 112 ppb. With this concentration control, even when the amount of metal ion added water supply is small, the metal ion amount necessary for delivering the antibacterial effect on the laundry can be secured, so that the antibacterial effect can be surely delivered by surely performing the antibacterial treatment on the laundry.

On the other hand, when the amount of metal ion added water supplied to the drum 630 is increased, the controller 690 decreases the metal ion concentration of the metal ion added water, for example, in a range where the concentration is not less than 112 ppb. In a case where the metal ion concentration is the same, when the amount of metal ion added water is increased, the amount of metal ions contained therein is increased accordingly. When the amount is excessively increased, excessive metal ions are not used for the antibacterial treatment on the laundry but are flown as drained water to be wasted. Moreover, it occurs that the amount of metal adhering to the laundry increases and this makes the laundry dirty. Therefore, such a problem can be avoided by the above-described concentration control.

The controller 690 may change the metal ion concentration of the metal ion added water in accordance with the supply water level of the metal ion added water supplied from the ion elution unit 100 to the drum 630. In this case, effects similar to the above-mentioned ones can be obtained.

Moreover, when the amount of metal ion added water supplied from the ion elution unit 100 to the drum 630 changes, the liquid ratio also changes. Here, the liquid ratio refers to the ratio (L/kg) between the laundry amount (kg) and the amount (L) of water supplied to the drum 630, in other words, refers to the amount of water used per kg of laundry. Therefore, it can be said that the controller 690 may change the metal ion concentration of the metal ion added water in accordance with the liquid ratio. For example, it is considered that the controller 690 performs control to increase the metal ion concentration to not less than 112 ppb when the liquid ratio is decreased and decrease the metal ion concentration, for example, in a range where the bacteriostasis activation value is not less than 2 when the liquid ratio is increased.

The amount (the total weight, the amount of load) of laundry put in the drum 630 can be sensed by non-illustrated sensing means. Consequently, the controller 690 calculates the liquid ratio based on the amount of laundry sensed by the sensing means and the amount of water usage set by the operation panel 616, and changes the metal ion concentration in accordance with the liquid ratio.

Even with this structure, a necessary amount of metal ions can be always secured in accordance with the amount of laundry irrespective of changes in liquid ratio. Consequently, even when the liquid ratio is changed by a change in the amount of metal ion added water supplied to the laundry tub, the antibacterial effect can be surely delivered by surely performing the antibacterial treatment on a predetermined amount of laundry. Also, it can be prevented that a necessary amount or more of metal ions are flown as drained water to be wasted without being used for the antibacterial treatment on the laundry and that the amount of metal adhering to the laundry increases and this makes the laundry dirty.

Moreover, various tests were performed under a condition where the cloth load was 7 kg and the water amount at the time of rinsing was 30 L, that is, under a condition where the cloth load of the laundry was 7 kg and the liquid ratio was 4.3 L/kg, and from these results, it can be said that in a washing machine that performs laundry washing and rinsing with the cloth load of the laundry being 7 kg and the liquid ratio being not more than 4.3 L/kg, by setting the metal ion concentration to not less than 112 ppb (more desirably, not less than 120 ppb ), the bacteriostasis activation value of the metal ion added laundry can be made not less than 2, so that an excellent antibacterial effect can be exerted on the laundry. Therefore, in a washing machine that performs laundry washing with the liquid ratio being 5 L/kg (the cloth load of the laundry being 7 kg), it is considered that the bacteriostasis activation value of the laundry is not less than 2 or a value close thereto, and it is considered that an excellent antibacterial effect is obtained.

That is, it is considered that the antibacterial effect can be surely exerted on the laundry by the controller 690 performing control so that when the liquid ratio of the metal ion added water used for the laundry is not more than 5 L/kg (the cloth load of the laundry 7 kg), the metal ion concentration of the metal ion added water supplied from the ion elution unit 100 is not less than 112 ppb (desirably, when the liquid ratio is not more than 4.3 L/kg (the cloth load of the laundry 7 kg), the metal ion concentration is not less than 120 ppb ). By doing this, metal ions with which a sufficient bacteriostasis activation value is obtained can be added to the laundry without an unnecessary amount of metal ions being consumed.

In other words, by setting a minimal metal ion concentration necessary for a washing machine that operates with a low liquid ratio, the following problem particular to washing machines can be solved: When the metal ion concentration is low, a sufficient antibacterial effect cannot be exerted on laundry where ones with high water absorbency and ones with low water absorbency are mixed, and when the metal ion concentration is excessively high, unnecessary metal ions are consumed. Consequently, an antibacterial effect by metal ions with efficiency can be exerted on the laundry.

While the control of the metal ion concentration is performed by the controller 690 in the above, the metal ion concentration may be preset in a range where the metal ion concentration is not less than 112 ppb (desirably, not less than 120 ppb ) and not more than 900 ppb.

Moreover, when the liquid ratio of the metal ion added water of a predetermined concentration and a predetermined amount (for example, 90 ppb and 42 L) used for a predetermined amount of laundry (for example, 7 kg) which metal ion added water is suitable for obtaining an effective bacteriostasis activation value (for example, not less than 2) is the reference liquid ratio (6 L/kg) in a case where metal ions are added, and the metal ion concentration (90 ppb ) is the concentration (reference concentration) in a case where a bacteriostasis activation value is obtained where it can be evaluated that an antibacterial effect is exerted at the reference liquid ratio, according to the present invention, the following control may be performed:

In controlling the amount of metal ion elution by the ion elution unit 100 so that the metal ion concentration is a predetermined reference concentration, when the liquid ratio of the amount of water used in at least one of the washing, rinsing, spin-drying and drying operations becomes lower than the reference liquid ratio for laundry of the amount (the total weight, the amount of load) the same as this, the controller 690 may perform control to increase the metal ion concentration to be higher than the reference concentration, and when the liquid ratio in the above-mentioned operation becomes higher than the reference liquid ratio for laundry of the amount the same as this, the controller 690 may perform control to maintain the metal ion concentration at the predetermined reference concentration or decrease it so as to be lower than the reference concentration.

By such metal ion concentration control, whatever change the liquid ratio makes, the metal ion amount necessary for delivering the antibacterial effect which amount depends on the amount of laundry being used (for example, the metal ion amount where the bacteriostasis activation value is not less than 2) can be substantially sufficiently secured. Consequently, even if the liquid ratio changes, the antibacterial effect can be surely exerted on the laundry being used while metal ions being used are prevented from being wasted, so that liquid ratio change can be sufficiently handled.

From the above, in the washing machine 1 of the present embodiment, the controller 690 performs control to change the metal ion concentration of the metal ion added water supplied from the ion elution unit 100 so that the bacteriostasis activation value of the metal ion added laundry is not less than 2 whatever changes the amount of supplied water, the water level of the supplied water and the liquid ratio make.

Moreover, from the above, the following can be said: The slanted drum washing machine 601 is a washing machine having the ion elution unit 100 that elutes metal ions from the electrodes 113 and 114 and adds them to water, and the drum 630 disposed so that the rotation axis thereof is at an angle with respect to the vertical direction and in which laundry is put, the metal ions are silver ions, and the silver ion concentration of the first metal ion added water is set so that the amount of silver ions contained in the first metal ion added water used for the antibacterial treatment on the laundry in the drum 630 is not less than the amount of silver ions contained in the second metal ion added water of an amount necessary for the antibacterial treatment on the laundry by vertical washing machines where the washing tub is disposed so that the rotation axis thereof is in the vertical direction.

Moreover, the following can also be said: The slanted drum washing machine 601 is a washing machine having the ion elution unit 100 that elutes metal ions from the electrodes 113 and 114 and adds them to water, and the drum 630 disposed so that the rotation axis thereof is at an angle with respect to the vertical direction and in which laundry is put, the metal ions are silver ions, and the silver ion concentration of the first metal ion added water used for the antibacterial treatment on the laundry in the drum 630 is set to a concentration where an antibacterial effect similar to that obtained by the second metal ion added water can be obtained with an amount of water smaller than the amount of second metal ion added water necessary for the antibacterial treatment on the laundry by vertical washing machines where the washing tub is disposed so that the rotation axis thereof is in the vertical direction.

While an example in which silver ions are mainly used as the metal ions is described in the present embodiment, it is to be noted that the structure of the present invention in which the metal ion concentration of the metal ion added water is changed according to the water amount and the liquid ratio may be adopted to a case where copper ions or zinc ions are used as the metal ions. Even in that case, the appropriate range of the metal ion concentration change is considered to be not less than 112 ppb and not more than 900 ppb, preferably, not less than 120 ppb and not more than 900 ppb.

(9. Control of the Amount of Metal Ion Added Water)

Next, the control of the amount of metal ion added water supplied from the ion elution unit 100 will be described.

It is as described above that the laundry washing process of the slanted drum washing machine 601 comprises a plurality of individual operations: the washing operation, the rinsing operation, the spin-drying operation, and when required, the drying operation. In the present embodiment, the controller 690 as the controlling means elutes metal ions (silver ions) from the ion elution unit 100 in any of the individual operations, and performs control so that the water amount in the individual operation in which the metal ion elution is performed is larger than that in the other operations.

In the present invention, the metal ion elution is performed in the rinsing operation as one of the individual operations as mentioned above, and at this time, the controller 690 performs control so that the water amount in the rinsing operation is larger than the water amount in the preceding washing operation. For example, when the water amount in the washing operation is 20 L, the water amount in the rinsing operation is, for example, 30 L.

This water amount control can be performed by the controller 690 adjusting the opening and closing of the water supply valve 50 for each individual operation. Specifically, the controller 690 causes the water supply valve 50 to be open until a water level sensor (not shown) detects a predetermined water level, and when the predetermined water level is detected, the controller 690 closes the water supply valve 50 to thereby adjust the water amount. Moreover, in this example, the silver ion concentration of the water (metal ion added water) to which metal ions (silver ions) eluted in the metal ion elution operation are added is the above-mentioned not less than 112 ppb and not more than 900 ppb which is a range suitable for the antibacterial treatment.

By the controller 690 performing control so that the water amount in an individual operation where silver ion elution is performed (for example, the rinsing operation) is larger than that in another individual operation (for example, the washing operation) as described above, the laundry (for example, cloth) in the drum 630 is more easily soaked in water in the individual operation (rinsing operation). Consequently, the eluted silver ions are apt to more uniformly adhere to the laundry. As a result, the antibacterial effect on the laundry can be more uniformly obtained on the entire laundry, and the antibacterial treatment can be made more effective.

In particular, by the controller 690 performing silver ion elution in the rinsing operation and performing control so that the water amount in the rinsing operation is larger than that in the preceding washing operation, the laundry is uniformly soaked in rinsing water (metal ion added water) at the time of rinsing of the laundry whose dirt has been removed in the washing operation, and the silver ions contained in the rinsing water more uniformly adhere to the entire laundry. Consequently, an antibacterial effect that is uniform on the entire laundry can be surely obtained by the antibacterial treatment at the time of rinsing.

(10. Rotation Control of the Drum)

Next, the rotation control of the drum 630 in the rinsing operation will be described.

Figure 6:
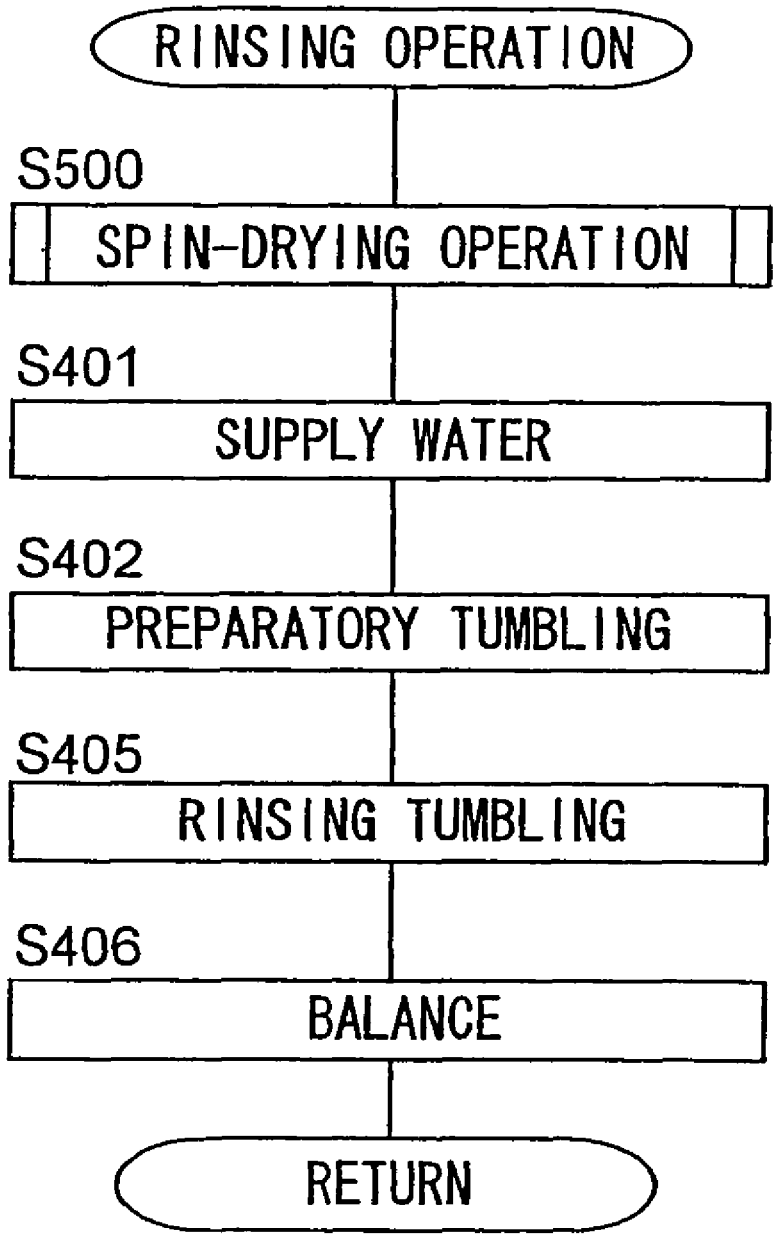
FIG. 6 is a flowchart showing the details of a rinsing operation in the laundry washing process.

In the present embodiment, as shown in the flowchart of FIG. 11, the elution of the metal ions (silver ions) from the ion elution unit 100 is performed, for example, in the water supply stage of step S401, that is, after the intermediate spin-drying of step S500 in the flow of the rinsing operation of FIG. 6. At this time, the controller 690 performs control to soak the laundry sticking to the inner surface of the drum 630 in the metal ion added water by supplying the metal ion added water to the drum 630 and rotating the drum 630 after the intermediate spin-drying.

In the case of vertical washing machines, since the laundry (for example, cloth) after spin-drying sticks to the entire area of the inner surface of the washing tub because the washing tub rotates at high speed at the time of spin-drying, when silver ion processing is performed on the entire laundry thereafter, it is necessary to increase the water level of the silver ion water in the washing tub so that the laundry is all soaked in the silver ion water and strongly agitate the laundry so as to be separated from the inner surface of the washing tub.

For this reason, in vertical washing machines, when silver ion water is supplied and silver ion rinsing is performed, for example, for ten minutes after the intermediate spin-drying in the rinsing operation, for example, for the first four minutes, the pulsator is turned on for 1.9 second, whereas it is turned off for 0.7 second to strongly agitate the laundry. Since the agitation by the pulsator which can largely damage cloth (laundry) and puts a heavy load on the motor cannot be performed for ten minutes, it is customary to perform agitation only for the first four minutes.

On the contrary, in the slanted drum washing machine 601 of the present embodiment, since the drum 630 makes slanted axis rotation or rotation close to that, by the intermediate spin-drying by rotation of the drum 630, even if the laundry sticks to the inner surface of the drum 630, the laundry can be soaked in the metal ion added water supplied in the drum 630 only by rotating the drum 630. When the drum 630 continues rotating, the laundry sticking to the inner surface of the drum 630 is repetitively soaked into the metal ion added water and separated from the water.

Since the laundry after the intermediate spin-drying sticks to the inner surface of the drum 630 and is not bulky, it is easily soaked in the silver ion water (metal ion added water) even if the water level of the silver ion water in the drum 630 is low. Therefore, water may be saved by performing control to set the liquid ratio at the time of the rinsing using the metal ion added water after the intermediate rinsing so as to be lower than that at the time of normal rinsing not using the metal ion added water and increase the silver ion concentration.

Therefore, in the slanted drum washing machine 601, it is unnecessary to rotate the drum 630 at a speed as high as the washing tub of vertical washing machines. Consequently, it is unnecessary to strongly agitate the laundry in the drum 630, so that the drum 630 can be rotated at a comparatively gentle rotation speed (for example, 50 rotations/min), for example, for ten minutes. As a result, damages (for example, wear and tear on cloth) due to laundry agitation can be suppressed. Moreover, the low-speed rotation of the drum 630 can reduce the load on the driving means (for example, a motor) thereof, so that the power consumption by not only the driving means but also the slanted drum washing machine 601 can be reduced.

In particular, by the controller 690 rotating the drum 630 at a comparative low rotation speed of not less than 10 rotations/min and not more than 120 rotations/min to thereby soak the laundry sticking to the inner surface of the drum 630 in the metal ion added water, the above-mentioned effect can be surely obtained.

Since the above-described advantages are produced, it can be said that the washing machine 601 of the present embodiment has a structure where the laundry tub in which laundry is put is the drum 630 disposed so that the rotation axis thereof is at an angle with respect to the vertical direction, the above-described laundry washing process includes the rinsing operation, metal ion elution by the controller 690 (controlling means) and the ion elution unit 100 is performed in the rinsing operation, and the laundry sticking to the inner surface of the drum 630 is soaked in the metal ion added water by supplying the metal ion added water to the drum 630 and rotating the drum 630 after the intermediate spin-drying in the rinsing operation.

(11. Antibacterial and Antifungal Effects in the Machine)

Next, the antibacterial and antifungal effects in the slanted drum washing machine 601 will be described.

In the slanted drum washing machine 601, since the drum 630 and the water tub 620 are substantially laterally disposed, laundry is frequently put in from the front of the washing machine 601. For this reason, the door 612 serving as the lid for putting laundry into the drum 630 is normally provided on the front of the washing machine 601.

However, when the door 612 is provided on a surface other than the top surface of the washing machine 601 like this, there is a possibility that water leaks therefrom. Therefore, in the washing machine 601, the door packing 613 is provided, and when the door 612 is closed, the performance of sealing between the door 612 and the body 610 is high and the body 610 can be sealed off. Moreover, in the slanted drum washing machine 601, unlike vertical washing machines, because of space limitation, it is difficult to keep the door 612 open when the washing machine is not in use.

Therefore, in the slanted drum washing machine 601, the water remaining in the washing machine 601 after laundry washing is finished does not easily vaporize. In some slanted drum washing machines 601, water is drained by a pump because of demands for incorporation into built-in kitchens, and particularly in this case, the amount of remaining water is large compared to natural water draining by the gravity.

Moreover, recently, some vertical washing machines have a structure with high sealing performance where a drying function is provided and neither heat and moisture at the time of drying nor produced dust leaks out. In this type of washing machines, water easily remains in the machine like in the slanted drum washing machine 601.

When water remains in the machine, the remaining water can become rotten to emit an offensive smell and mold easily propagates, so that the hygienic condition is degraded. In particular, in the machine, since nutritive substances such as dirt that adhered to the laundry and detergent residues are abundant, bacteria and mold readily propagate. Moreover, when such bacteria adhere to the laundry, the laundry becomes dirty, and the skin can be adversely affected when the washed cloths are worn.

Therefore, in the present embodiment, this problem is avoided by adopting the following structure:

In the slanted drum washing machine 601 of the present embodiment, the water remaining in the machine after all the individual operations (the washing operation, the rinsing operation, the spin-drying operation, and when required, the drying operation) in the laundry washing process are finished (more specifically, water remaining in the drain path from the ion elution unit 100 through the drain pipe 664) is the metal ion added water (silver ion water) containing metal ions (silver ions) eluted from the ion elution unit 100. This can be realized by the controller 690 performing control to elute metal ions from the ion elution unit 100 and add them to the water in, of the laundry washing process, the last individual operation that requires water.

For example, when the drying operation is not performed in accordance with the laundry washing mode, as shown in the flowchart of FIG. 4, the controller 690 performs the above-described silver ion water supply in the last operation, that requires water, of the individual operations (the final rinsing operation (step S400-3 of FIG. 4) of the rinsing operation). In this case, the silver ion water supplied to the drum 630 is used for the antibacterial treatment on the laundry, and is then removed from the laundry in the spin-drying operation and drained out of the machine. At this time, the silver ion water is not completely drained out of the machine but a slight amount thereof normally remains in the drum 603 and in the drain path (for example, in the drain pipe 664) without being drained. Moreover, after the last individual operation that requires water is finished, it never occurs that different water flows in the drum 63 and the drain path.

Moreover, when the last operation is the drying operation by water-cooling dehumidification, in the drying operation, the controller 690 performs control to add the metal ions eluted from the ion elution unit 100 to the cooling water for cooling the air discharged from the drum 630. In this case, after the cooling of the air is finished, the cooling water is drained out of the machine through a drain path (for example, the drain pipe 664). Even in this case, the cooling water is not completely drained out of the machine but a slight amount thereof normally remains in the drain path without being drained. Moreover, since the drying operation is the last operation of the laundry washing process, it never occurs that different water flows in the drain path.

Since the drying operation employing the water-cooling dehumidification method requires the cooling water and the drying operation is the individual operation performed lastly in the laundry washing process, it can be said that the drying operation is the last individual operation, that requires water, of the laundry washing process.

As described above, when at least one individual operation of the laundry washing process is performed, the controller 690 (controlling means) performs control to elute metal ions from the ion elution unit 100 and add them to water in, of the individual operations, the last individual operation that requires water. With this, after all the individual operations of the laundry washing process are finished, even if water remains in the machine (in the drain path from the ion elution unit 100 through the drain pipe 664), the remaining water is metal ion added water.

When the water remaining in the machine is normal tap water, there are cases where the water becomes rotten to emit an offensive smell and mold propagates. In particular, in the slanted drum washing machine 601, since it is necessary to prevent water from leaking from the door 612 or the like on the front, the sealing performance is high compared to vertical washing machines and therefore, the water remaining in the drum 630 in the machine particularly does not easily vaporize and an offensive smell and mold are readily generated as mentioned above.

However, by employing the above-described structure of the present embodiment, since the water remaining in the machine after the last operation is finished is antibacterial metal ion water, even in the highly hermetically sealed machine, by the antibacterial performance of the metal ions (silver ions) contained in the metal ion water, it can be surely prevented that an offensive smell is emitted from the remaining water and mold propagates in the machine because of the remaining water. Consequently, a slanted drum washing machine 601 excellent in hygienic condition can be realized.

Moreover, when the last individual operation that requires water is the rinsing operation in which the laundry put in the laundry tub is rinsed, the controller 690 adds the metal ions eluted from the ion elution unit 100 to the water supplied to the laundry tub in the rinsing operation. With this, the hygienic condition can be surely improved by suppressing the generation of an offensive smell and mold by the metal ion added water remaining in the machine after the rinsing operation is finished.

Moreover, when the last individual operation is the drying operation in which the laundry is dried by supplying hot air to the laundry tub in which the laundry is put and the air discharged from the laundry tub is cooled by the cooling water, the controller 690 adds the metal ions eluted from the ion elution unit 100 to the cooling water in the drying operation. With this, the hygienic condition can be surely improved by suppressing the generation of an offensive smell and mold by the metal ion added water remaining in the machine after the drying operation is finished.

While the above description is given based on the premise that the drain path through which water is drained from the laundry tub (drum 630) (hereinafter, referred to also as a first drain path) and the drain path of the cooling water used in the drying operation (hereinafter, referred to also as a second drain path) are common, there are cases where it is difficult that such drain paths are common because of the structure of the washing machine 601. That is, there are cases where the first drain path and the second drain path are partly or totally different.

In a case where the first drain path and the second drain path are thus at least partly different, when (1) the drying operation in which hot air is supplied to the laundry tub to dry the laundry and the air discharged from the laundry tub is cooled by cooling water and (2) an operation (for example, the rinsing operation) in which water is supplied to the laundry tub immediately before the drying operation are both performed as the individual operations constituting the laundry washing process in accordance with the selected laundry washing mode, the last individual operation that requires water is the operation of (1). Therefore, even if metal ions are added only to the cooling water used in the last individual operation, the metal ion added water cannot be left in the first drain path although the metal ion added water can be left in the second drain path.

Therefore, in a case where the first drain path and the second drain path are at least partly different and the operations of (1) and (2) are both performed, the controller 690 performs control to add the metal ions eluted from the ion elution unit 100 to both the water supplied to the laundry tub in the operation of (2) and the cooling water used in the drying operation of (1).

By doing this, after the operations of (1) and (2) are finished, the metal ion added water can be left in each of the first and second drain paths in the end. Consequently, the generation of an offensive smell due to rotting of the water remaining in the drain paths in the machine and the propagation of mold can be suppressed, so that a washing machine excellent in hygienic condition can be realized.

(12. Others)

While an embodiment of the present invention has been described, the scope of the invention is not limited thereto, but the present invention may be embodied with various modifications added thereto without departing from the spirit of the invention.

For example, the position of disposition of the ion elution unit 100 is not limited to between the water supply valve 50 and the water supply mouth 53. The ion elution unit 100 may be disposed anywhere between the connection pipe 51 and the water supply mouth 53. That is, it may be disposed on the upstream side of the water supply valve 50. When the ion elution unit 100 is disposed on the upstream side of the water supply valve 50, the ion elution unit 100 is always soaked in water, so that it can be prevented that water leakage is caused by the sealing member being changed in quality by being dried.

Moreover, the ion elution unit 100 may be disposed outside an outer case 10. For example, a structure is considered such that the ion elution unit 100 is formed as an interchangeable cartridge and attached to the connection pipe 51 by means such as screwing and a water supply hose is connected to the cartridge.

Aside from whether the ion elution unit 100 is in the form of a cartridge or not, when the ion elution unit 100 is disposed outside the outer case 10, the ion elution unit 100 can be replaced without the door provided on a part of the washing machine 1 being opened or the panel being detached, which facilitates maintenance. Further, the charging portion inside the washing machine 1 cannot be touched, which ensures safety.

To the ion elution unit 100 disposed outside the outer case 10 as described above, electric current is supplied by connecting a cable extending from the driving circuit 120 through a waterproof connector. Without resort to power supply from the driving circuit 120, the machine may be driven with a battery as a power source, or may be driven with a hydraulic power unit having a water wheel so as to be in contact with the flow of the supplied water, as a power source.

The ion elution unit 100 may be sold as an independent product so that mounting of the ion elution unit 100 on apparatuses other than washing machines is promoted.

Moreover, the ion elution unit 100 may be disposed in a position in the water tub 620 which position is soaked in water when water is supplied to a predetermined water level: By doing this, when the ion elution unit 100 is soaked in the water in the water tub 620, metal ions can be eluted at any time irrespective of the water supply timing. Consequently, a sufficient time can be taken to elute metal ions, so that metal ions can be used in a high concentration and the current and voltage can be low to obtain a predetermined concentration.

Moreover, since it is unnecessary to provide a water supply sequence in the laundry washing process for ion elution, it is unnecessary that the time required for performing all the operations of laundry washing be long. Further, when metal ions are added to the water supplied to the drum 630, it is necessary to reduce the water supply flow amount in order to secure the time necessary for metal ion elution. Although this leads to an increase in the time required for laundry washing, this structure unnecessitates such a consideration.

While the slanted washing machine 601 having the drum 630 disposed so that the rotation axis thereof is at an angle with respect to the vertical direction as the laundry tub in which laundry is put is described in the present embodiment, it is to be noted that the structures described in the present embodiment such as the structure in which the metal ion concentration of the metal ion added water is changed according to the water amount and the liquid ratio are applicable to vertical washing machines having a washing tub as the laundry tub so that the rotation axis thereof is in the vertical direction.

Moreover, the ion eluting means for eluting metal ions is not limited to the above-described structure (ion elution unit 100). The ion eluting means may comprise a structure in which a metal ion eluting material (in the case of a silver eluting material, silver sulfide or the like) is filled in a cartridge and water is passed through the cartridge to thereby elute metal ions. The above-described ion elution unit 100 or one capable of performing metal ion concentration control equal thereto is suitable in that the metal ion concentration of a limited amount of supplied water can be finely controlled in a short time.

INDUSTRIAL APPLICABILITY

The present invention is applicable to a washing machine having ion eluting means for generating metal ion added water used for correcting imbalance in the laundry tub (the drum, the washing tub) at the time of spin-drying rotation.

The invention claimed is:

1. A washing machine, comprising:

a laundry tub in which laundry is put;

a water supply unit that supplies water to the laundry tub;

an agitating unit that agitates the laundry in the laundry tub;

an ion eluting portion for eluting metal ions and adding the eluted metal ions to water;

a sensing portion for sensing imbalance at the time of rotation of the laundry tub; and a control unit configured to operate such that, on recognizing that the sensing portion has sensed imbalance during spin-drying rotation, if before the spin-drying rotation the ion eluting portion was controlled so as not to supply metal ions to the laundry tub, the control unit performs a first balance correction rinsing in which the control unit controls the water supply unit and the ion eluting portion to supply water containing no metal ions to the laundry tub and controls the agitating unit to perform agitation, and if before the spin-drying rotation the ion eluting portion was controlled so as to supply metal ions to the laundry tub, the control unit performs a second balance correction rinsing in which the control unit controls the water supply unit and the ion eluting portion to supply water containing metal ions to the laundry tub and controls the agitating unit to perform agitation.

2. A washing machine according to claim 1, wherein the control unit sets an amount of supply of the metal ion added water to the laundry tub in the second balance correction rinsing so as to be smaller than an amount of supply of the metal ion added water in a preceding operation.

3. A washing machine according to claim 1, wherein the control unit sets a metal ion concentration of the metal ion added water to the laundry tub in the second balance correction rinsing so as to be lower than a metal ion concentration of the metal ion added water in a preceding operation.

4. A washing machine according to claim 1, wherein the laundry tub is a drum disposed so that a rotation axis thereof is slanted with respect to a vertical direction.

5. A washing machine according to claim 2, wherein the laundry tub is a drum disposed so that a rotation axis thereof is slanted with respect to a vertical direction.

6. A washing machine according to claim 3, wherein the laundry tub is a drum disposed so that a rotation axis thereof is slanted with respect to a vertical direction.

7. A washing machine according to claim 1, wherein the control unit is configured to operate such that, on recognizing that the sensing portion has sensed imbalance during spin-drying rotation, if before the spin-drying rotation the ion eluting portion was controlled so as not to supply metal ions to the laundry tub, before performing the second balance correction rinsing, the control unit controls the agitating unit to perform balance correction by agitation without supply of the water containing metal ions, and thereafter on recognizing that the sensing portion is still sensing imbalance during the spin-drying rotation, the control unit performs the second balance correction rinsing.

8. A washing machine, comprising:

a laundry tub for accommodating laundry therein;

a water supply unit for supplying water to the laundry tub;

an agitating unit for agitating the laundry in the laundry tub;

an ion eluting portion for eluting metal ions and adding the eluted metal ions to water supplied by the water supply unit;

a sensing portion for sensing imbalance of the laundry at the time of rotation of the laundry tub and outputting a detection signal;

a selection unit for selecting between a first mode in which the eluted metal ions are not to be added to the water supplied to the laundry tub prior to a spin-drying rotation, and a second mode in which the eluted metal ions are to be added to the water supplied to the laundry tub prior to the spin-drying rotation, and outputting a selection signal; and a control unit configured to operate such that, on recognizing that the sensing portion has sensed imbalance during the spin-drying rotation, if the selection signal is recognized to be indicating the first mode, the control unit performs a first balance correction rinsing in which the control unit controls the water supply unit and the ion eluting portion to supply water containing no metal ions to the laundry tub and controls the agitating unit to perform agitation, and if the selection signal is recognized to be indicating the second mode, the control unit performs a second balance correction rinsing in which the control unit controls the water supply unit and the ion eluting portion to supply water containing metal ions to the laundry tub and controls the agitating unit to perform agitation.

* * * * *